US011824262B2

(12) United States Patent
Xi et al.

(10) Patent No.: US 11,824,262 B2
(45) Date of Patent: Nov. 21, 2023

(54) ANTENNA, PHASE SHIFTER, AND COMMUNICATION DEVICE

(71) Applicants: Shanghai AVIC OPTO Electronics Co., Ltd., Shanghai (CN); Shanghai Tianma Micro-Electronics Co., Ltd., Shanghai (CN)

(72) Inventors: Kerui Xi, Shanghai (CN); Xuhui Peng, Shanghai (CN); Feng Qin, Shanghai (CN); Tingting Cui, Shanghai (CN); Baiquan Lin, Shanghai (CN)

(73) Assignees: Shanghai AVIC OPTO Electronics Co., Ltd., Shanghai (CN); Shanghai Tianma Micro-Electronics Co., Ltd., Shanghai (CN)

( * ) Notice: Subject to any disclaimer, the term of this patent is extended or adjusted under 35 U.S.C. 154(b) by 25 days.

(21) Appl. No.: 17/361,356

(22) Filed: Jun. 29, 2021

(65) Prior Publication Data

US 2022/0285852 A1 Sep. 8, 2022

(30) Foreign Application Priority Data

Mar. 2, 2021 (CN) ..... 202110231869.7

(51) Int. Cl.
*H01Q 19/00* (2006.01)
*H01Q 21/06* (2006.01)
(Continued)

(52) U.S. Cl.
CPC ..... *H01Q 1/005* (2013.01); *H01Q 5/371* (2015.01); *H01Q 21/065* (2013.01)

(58) Field of Classification Search
CPC .... H01Q 19/005; H01Q 5/371; H01Q 21/065; H01Q 3/36; H01Q 1/364; H01Q 3/34; H01Q 3/44; H01P 1/18
See application file for complete search history.

(56) References Cited

U.S. PATENT DOCUMENTS

2005/0270121 A1* 12/2005 Castiglione ..... H01P 1/182 333/81 B
2008/0036664 A1 2/2008 Haziza
(Continued)

FOREIGN PATENT DOCUMENTS

CN 100553029 C 10/2009
CN 107706502 A 2/2018
(Continued)

OTHER PUBLICATIONS

First Office Action received in the corresponding Chinese Application 202110231869.7, dated Apr. 21, 2023.

*Primary Examiner* — Hai V Tran
*Assistant Examiner* — Michael M Bouizza
(74) *Attorney, Agent, or Firm* — KILPATRICK TOWNSEND & STOCKTON, LLP

(57) ABSTRACT

Provided are an antenna, a phase shifter, and a communication device. The antenna includes a first metal electrode, a second metal electrode, and a photo-sensitive layer. The first metal electrode and the second metal electrode are respectively located on two opposite sides of the photo-sensitive layer. The first metal electrode includes multiple transmission electrodes. The multiple transmission electrodes are configured to transmit electrical signals. The photo-sensitive layer includes at least one photo-sensitive unit and the at least one photo-sensitive unit overlaps the transmission electrodes. The antenna provides more possibilities for large-scale commercialization.

19 Claims, 22 Drawing Sheets

(51) Int. Cl.
*H01Q 5/371* (2015.01)
*H01Q 1/00* (2006.01)

(56) References Cited

U.S. PATENT DOCUMENTS

| | | | | |
|---|---|---|---|---|
| 2012/0262653 | A1* | 10/2012 | Shimizu | G02F 1/133707 349/191 |
| 2015/0222019 | A1* | 8/2015 | Robson | H01Q 3/01 343/904 |
| 2016/0238766 | A1* | 8/2016 | Huang | G02B 5/201 |
| 2018/0294557 | A1* | 10/2018 | Lu | H01Q 19/067 |
| 2019/0371830 | A1* | 12/2019 | Hsiao | G06F 3/0445 |
| 2021/0083379 | A1* | 3/2021 | Cao | H01Q 21/065 |
| 2022/0029280 | A1* | 1/2022 | Huh | H01Q 1/364 |
| 2022/0094056 | A1* | 3/2022 | Yang | H01Q 3/36 |
| 2022/0285843 | A1* | 9/2022 | Wang | H01Q 3/36 |

FOREIGN PATENT DOCUMENTS

| | | | |
|---|---|---|---|
| CN | 110350325 | A | 10/2019 |
| JP | 2014127889 | A | 7/2014 |
| JP | 2020150496 | A | 9/2020 |

* cited by examiner

ANTENNA, PHASE SHIFTER, AND COMMUNICATION DEVICE

CROSS-REFERENCE TO RELATED APPLICATION(S)

This application claims priority to Chinese Patent Application No. 202110231869.7 filed Mar. 2, 2021, the disclosure of which is incorporated herein by reference in its entirety.

FIELD

Embodiments of the present disclosure relate to the field of communication technologies and in particular, to an antenna, a phase shifter, and a communication device.

BACKGROUND

An antenna is an important radio device that transmits and receives electromagnetic waves. It can be said that without the antenna, there is no communication device.

The phased array antenna is an upgrade of the traditional antenna. The phased array antenna can quickly and flexibly change the antenna beam and pointing shape according to the target and can transmit and receive electromagnetic waves in various frequency bands in the entire space, that is, the phased array antenna can accurately complete tasks such as searching, tracking, capturing, and recognition of multiple targets.

The liquid crystal phased array antenna is an antenna that uses the dielectric anisotropy of the liquid crystal to change the phase shift size of the phase shifter by controlling the deflection direction of the liquid crystal, to adjust the alignment direction of the phased array antenna. The liquid crystal phased array antenna has characteristics such as miniaturization, broadband, multi-band, and high gain, is more suitable for the current technological development, and has an extensive application prospect in the fields such as satellite receiving antennas, vehicle-borne radars, and base station antennas. Therefore, the liquid crystal phased array antenna is currently the most studied phased array antenna. However, the cost and price of the liquid crystal antenna are high, making it difficult to achieve large-scale commercialization.

SUMMARY

Embodiments of the present disclosure provide a new type of antenna, phase shifter, and communication device so that more possibilities are provided for large-scale commercialization.

Embodiments of the present disclosure provide an antenna. The antenna includes a first metal electrode, a second metal electrode, and a photo-sensitive layer.

The first metal electrode and the second metal electrode are respectively located on two opposite sides of the photo-sensitive layer.

The first metal electrode includes multiple transmission electrodes; the multiple transmission electrodes are configured to transmit electrical signals.

The photo-sensitive layer includes at least one photo-sensitive unit and the at least one photo-sensitive unit overlaps the transmission electrodes.

Embodiments of the present disclosure provide a phase shifter. The phase shifter includes a first metal electrode, a second metal electrode, and a photo-sensitive layer.

The first metal electrode and the second metal electrode are respectively located on two opposite sides of the photo-sensitive layer.

The first metal electrode includes multiple transmission electrodes; the multiple transmission electrodes are configured to transmit electrical signals.

The photo-sensitive layer includes at least one photo-sensitive unit and the at least one photo-sensitive unit overlaps the transmission electrodes.

Embodiments of the present disclosure further provide a communication device. The communication device includes a light source and the antenna described in some embodiments or the phase shifter described in other embodiments.

In the antenna, phase shifter, and communication device provided in embodiments of the present disclosure, a photo-sensitive layer is disposed between the first metal electrode and the second metal electrode, and the phase shift of the electrical signals transmitted by the transmission electrodes is controlled by controlling a dielectric constant of the photo-sensitive layer. This new type of antenna, phase shifter, and communication device provide more possibilities for large-scale commercialization.

DETAILED DESCRIPTION

Figure 1:
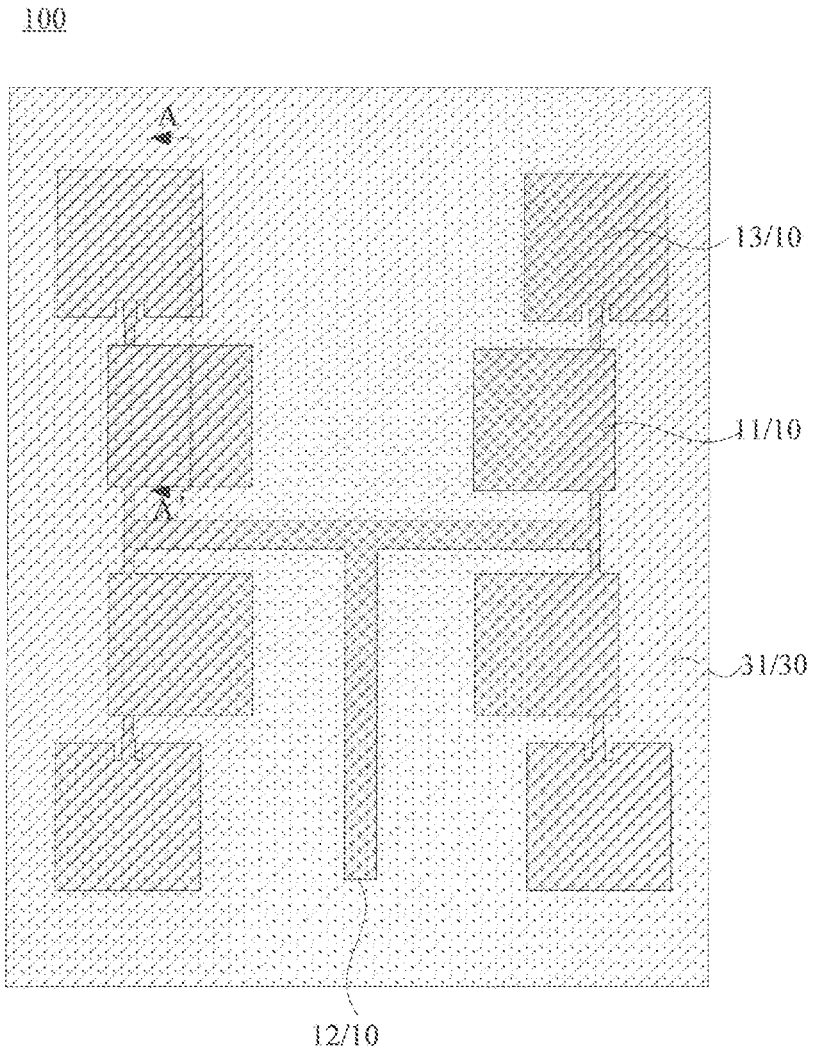
FIG. 1 is a top diagram of an antenna according to an embodiment of the present disclosure.

The present disclosure is further described hereinafter in detail in conjunction with drawings and embodiments. It is to be understood that embodiments described hereinafter are intended to explain the present disclosure and not to limit the present disclosure. Additionally, it is to be noted that for ease of description, only part, not all, of structures related to the present disclosure are illustrated in the drawings.

In view of the problems in the background art, embodiments of the present disclosure provide an antenna. The antenna includes a first metal electrode, a second metal electrode, and a photo-sensitive layer. The first metal electrode and the second metal electrode are respectively located on two opposite sides of the photo-sensitive layer. The first metal electrode includes multiple transmission electrodes. The multiple transmission electrodes are configured to transmit electrical signals. The photo-sensitive layer includes at least one photo-sensitive unit and the at least one photo-sensitive unit overlaps the transmission electrodes.

In the antenna provided in this embodiment, the photo-sensitive layer is disposed between the first metal electrode and the second metal electrode, and the phase shift of the electrical signals transmitted by the transmission electrodes is controlled by controlling a dielectric constant of the photo-sensitive layer. The antenna structure provided in this embodiment provides more possibilities for large-scale commercialization.

Figure 2:
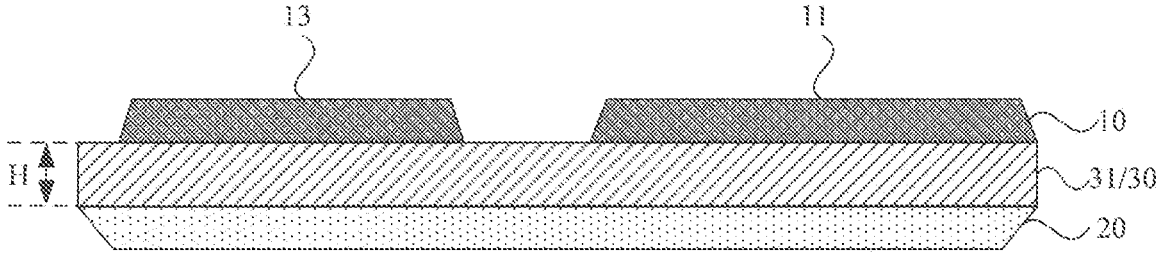
FIG. 2 is a structure diagram of FIG. 1 taken along an A-A' section.

FIG. 1 is a top diagram of an antenna according to an embodiment of the present disclosure, and FIG. 2 is a structure diagram of FIG. 1 taken along an A-A' section. As shown in FIGS. 1 and 2, the antenna 100 provided in embodiments of the present disclosure includes a first metal electrode 10, a second metal electrode 20, and a photo-sensitive layer 30; the first metal electrode 10 and the second metal electrode 20 are respectively located on two opposite sides of the photo-sensitive layer 30; the first metal electrode 10 includes multiple transmission electrodes 11; the multiple transmission electrodes 11 are configured to transmit electrical signals; the photo-sensitive layer 30 includes at least one photo-sensitive unit 31 and the at least one photo-sensitive unit 31 overlaps the transmission electrodes 11. In FIG. 1, only the case where the photo-sensitive layer 30 includes one photo-sensitive unit 31 is used as an example for description. In the case where the photo-sensitive layer 30 includes one photo-sensitive unit 31, the photo-sensitive unit 31 may be, for example, a full layer structure.

For example, the dielectric constant of the photo-sensitive unit 31 may be controlled to change by controlling the light intensity; the dielectric constant of the photo-sensitive unit 31 may also be controlled to change by using the wavelength, which is not limited in this embodiment as long as the dielectric constant of the photo-sensitive unit 31 is changed.

In this embodiment, the transmission electrodes 11 are configured to transmit electrical signals, and the second metal electrode 20 is provided with a fixed potential. For example, the second metal electrode 20 is grounded. During the transmission of electrical signals, due to the change of the dielectric constant of the photo-sensitive unit 31 (the dielectric constant of the photo-sensitive unit 31 is changed after the photo-sensitive unit 31 is affected by the light intensity or wavelength), the capacitance value of the capacitor formed between the transmission electrodes 11 and the second metal electrode 20 is changed, leading to the change of the phases of the electrical signals transmitted by the transmission electrodes 11. In this manner, the phases of the electrical signals are changed and the phase shift function of the electrical signals is achieved. This embodiment does not limit the material of the photo-sensitive unit 31. In some embodiments, a selection according to the actual condition as long as through the change of the dielectric constant of the photo-sensitive unit 31, the phase shift of the electrical signals transmitted in the transmission electrodes 11 is performed, and the phases of the electrical signals are changed. In an embodiment, the material of the photo-sensitive unit 31 may include azo dye or azo polymer.

It is to be understood that the photo-sensitive unit 31 overlaps the transmission electrodes 11. It is feasible that the photo-sensitive unit 31 may partially overlap the transmission electrodes 11; it is also feasible that the transmission electrodes 11 coincide with the photo-sensitive unit 31; it is also feasible that the transmission electrodes 11 are located in the projection of the photo-sensitive unit 31. It is also to be understood that the photo-sensitive unit 31 overlaps the transmission electrodes 11, and it is feasible that in the thickness direction of the photo-sensitive unit 31, the photo-sensitive unit 31 overlaps the transmission electrodes 11. In an embodiment, in the case where the transmission electrodes 11 are planar transmission electrodes, the photo-sensitive unit 31 overlaps the transmission electrodes 11, and it is feasible that the vertical projection of the photo-sensitive unit 31 on a plane where the transmission electrodes 11 are located overlaps the transmission electrodes 11.

Figure 3:
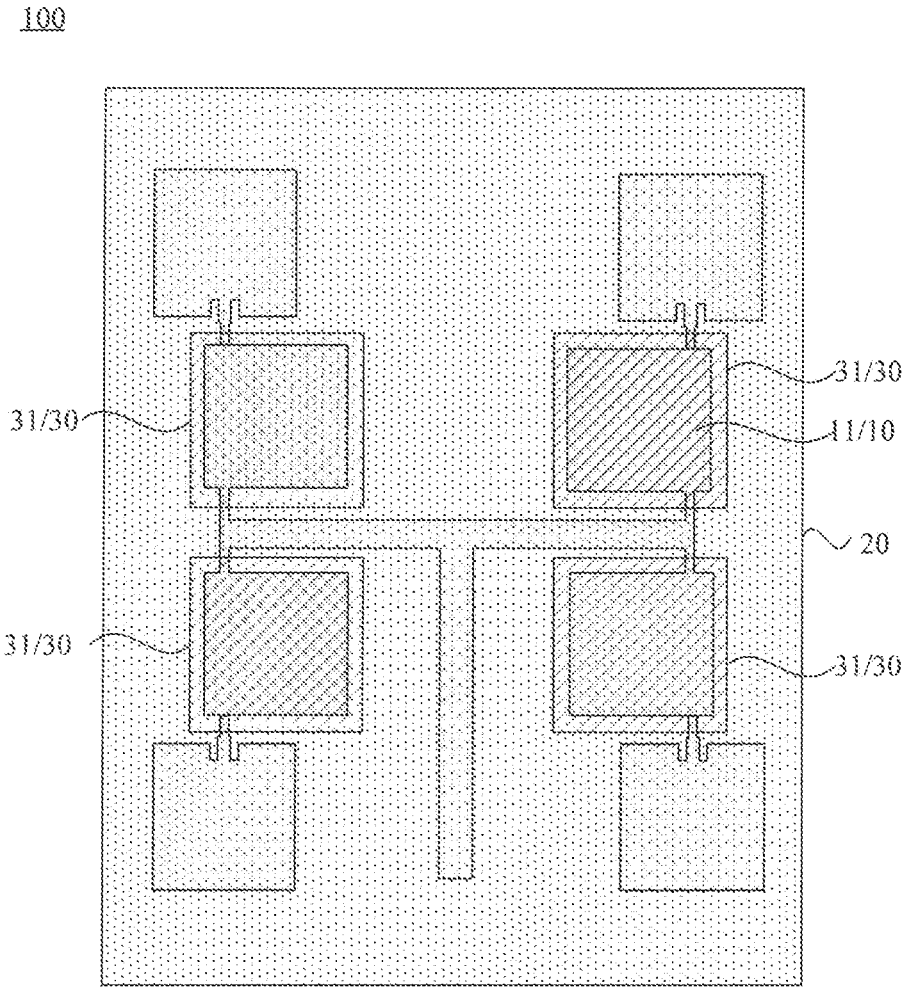
FIG. 3 is a top diagram of another antenna according to an embodiment of the present disclosure.

It is to be noted that in FIG. 1, the case where an antenna 100 includes four transmission electrodes 11 and one photo-sensitive unit 31 is used as an example for description, that is, the photo-sensitive unit 31 is arranged in a full layer. In other embodiments, the antenna 100 may further include multiple photo-sensitive units 31. The multiple photo-sensitive units 31 and the multiple transmission electrodes 11 are arranged in a one-to-one correspondence. In an embodiment, FIG. 3 is a top diagram of another antenna according to an embodiment of the present disclosure. As shown in FIG. 3, the photo-sensitive layer 30 includes four photo-sensitive units 31, and each photo-sensitive unit 31 corresponds to and overlaps a respective one of the multiple transmission electrodes 11.

In the antenna structure provided in the present application, since the signals are changed by using the change of the dielectric constant of the photo-sensitive layer 30 and the change of the dielectric constant of the photo-sensitive layer 30 is generated by the stimulation of the light source, compared with the liquid crystal antenna, there is no need to provide driving electrodes to control the dielectric constant of a liquid crystal layer to change. Therefore, as for the antenna structure, the manufacturing of driving electrodes can be avoided in the manufacturing process so that the production cost can be further reduced.

In an embodiment, with continued reference to FIG. 2, the thickness of the photo-sensitive layer 30 is H, that is, the thickness of the photo-sensitive unit 31 is H, where 10 μm≤H≤1000 μm.

The thickness of the photo-sensitive unit 31 is set between 10 μm and 100 μm, that is, the following cases are avoided: since the thickness of the photo-sensitive unit 31 is too great, the loss of the electrical signals transmitted by the transmission electrodes 11 occurs in the photo-sensitive unit 31; and since the thickness of the photo-sensitive unit 31 is too small, the bandwidths of the electrical signals are too narrow and the application of the antenna is limited. For example, the bandwidths of the electrical signals transmitted to the transmission electrodes 11 is between 5 GHz±0.5 GHz, that is, between 4.5 GHz and 5.5 GHz. Under the same structure, if the thickness of the photo-sensitive unit 31 is too small, the frequencies of the electrical signals transmitted by the transmission electrodes 11 are only between 5 GHz±0.2 GHz, that is, between 4.8 GHz and 5.2 GHz. In this manner, the bandwidths of the electrical signals are narrowed, and part of the electrical signals are lost so that the application of the antenna is limited; further, if the thickness of the photo-sensitive unit 31 is too small, the influence of the process fluctuation on the thickness of the photo-sensitive unit 31 is increased, the influence of the process fluctuation on the capacitance value of the capacitor formed between the transmission electrodes 11 and the second metal electrode 20 is increased, and thus the phase shift of the electrical signals transmitted in the transmission electrodes 11 is affected. Therefore, in this embodiment, the thickness of the photo-sensitive unit 31 is set between 10 μm and 100 μm so that while the normal transmission of the electrical signals is ensured, the application range of the antenna is also expanded and the phase shift of the electrical signals transmitted in the transmission electrodes 11 is ensured.

In an embodiment, the electrical signals transmitted by the transmission electrodes 11 may be, for example, high-frequency signals. The frequencies of the high-frequency signals are, for example, greater than or equal to 1 GHz. In this manner, the antenna may be applied to long-distance and high-speed transmission devices such as satellites and base stations. Moreover, the manufacturing of driving electrodes in the manufacturing process of the antenna can be avoided, that is, the production cost can be reduced. Therefore, the antenna has high commercial application value.

It is to be understood that the electrical signals transmitted by the transmission electrodes 11 include and are not limited to the preceding examples.

To sum up, in the antenna provided in embodiments of the present disclosure, the photo-sensitive layer is disposed between the first metal electrode and the second metal electrode, and the phase shift of the electrical signals transmitted by the transmission electrodes is controlled by controlling the dielectric constant of the photo-sensitive layer. This new type of antenna provides more possibilities for large-scale commercialization.

In an embodiment, with continued reference to FIG. 1, the antenna 100 provided in embodiments of the present disclosure further includes a feed network 12, the feed network 12 and the transmission electrodes 11 are arranged in the same layer, and the feed network 12 is electrically connected to the transmission electrodes 11.

The feed network 12 is distributed in an arborescent shape and includes multiple branches. One branch is electrically connected to one transmission electrode 11. The feed network 12 transmits the electrical signals to each transmission electrode 11, the dielectric constant of the photo-sensitive unit 31 is changed through the light intensity or wavelength, and the phase shift of the electrical signals transmitted in the transmission electrodes 11 is performed so that the phase shift function of the electrical signals is achieved.

In this embodiment, the feed network 12 and the transmission electrodes 11 are arranged in the same layer, and the feed network 12 is electrically connected to the transmission electrodes 11. In the liquid crystal antenna, the electrical signals transmitted by the feed network are coupled to the transmission electrodes through the liquid crystal layer. In some embodiments, since the feed network 12 is directly electrically connected to the transmission electrodes 11, the electrical signals may be directly transmitted to the transmission electrodes 11 without coupling. In this manner, the problem of electrical signal loss due to coupling can be avoided.

In an embodiment, with continued reference to FIGS. 1 and 2, the first metal electrode 10 further includes multiple radiators 13; the radiators 13, the transmission electrodes 11, and the feed network 12 are arranged in the same layer, and the transmission electrodes 11 are electrically connected to the radiators 13.

In this embodiment, the first metal electrode 10 includes the radiators 13, the transmission electrodes 11, and the feed network 12, the feed network 12 is electrically connected to the transmission electrodes 11, and the transmission electrodes 11 are electrically connected to the radiators 13. In this manner, the feed network 12 directly transmits the electrical signals to the transmission electrodes 11 without coupling; then the electrical signals are transmitted in the transmission electrodes 11; at the same time, the dielectric constant of the photo-sensitive unit 31 is controlled to change by the light intensity or wavelength; after the phase shift of the electrical signals transmitted in the transmission electrodes 11 is performed, the signals are directly radiated outward through the radiators 13 without coupling. In the liquid crystal antenna, the electrical signals transmitted by the feed network are coupled to the transmission electrodes through the liquid crystal layer and then coupled to the radiators through the liquid crystal layer. In the embodiment, the problem of electrical signal loss due to two times of coupling can be avoided.

Further, the radiators 13, the transmission electrodes 11, and the feed network 12 are arranged in the same layer and may be formed at the same time through one manufacturing process, which can greatly reduce the production cost and is more conducive to large-scale commercial applications.

Figure 4:
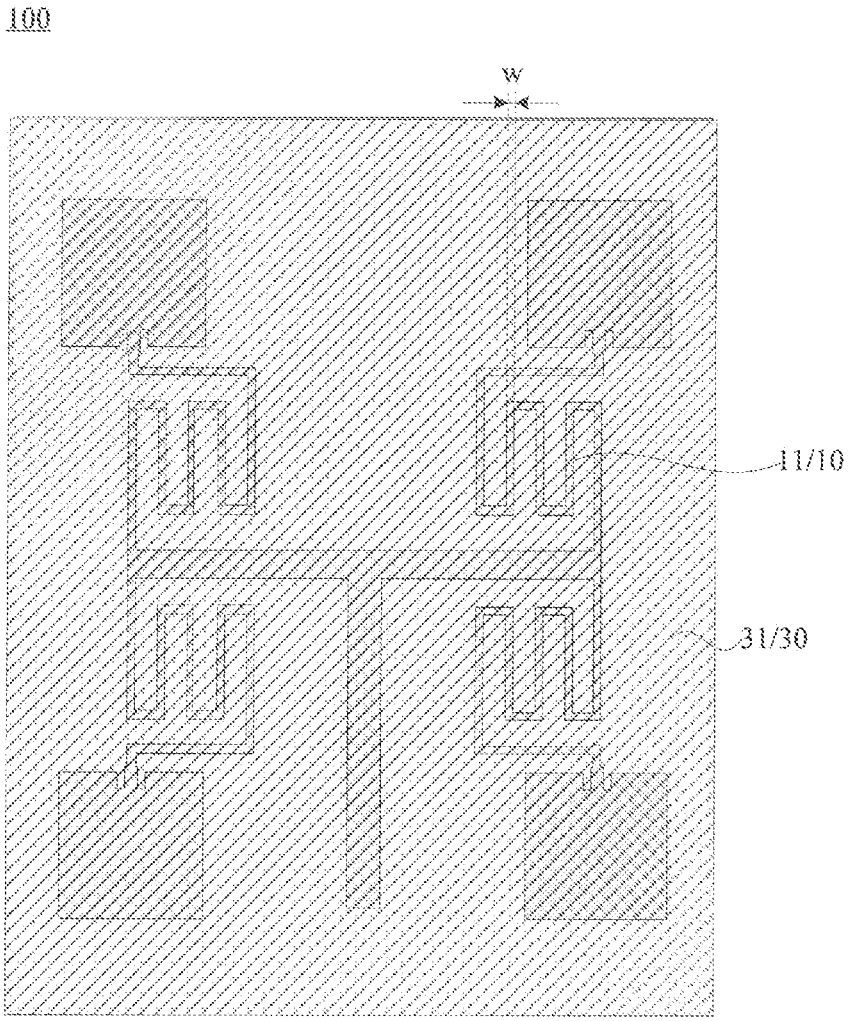
FIG. 4 is a top diagram of another antenna according to an embodiment of the present disclosure.

In an embodiment, FIG. 4 is a top diagram of another antenna according to an embodiment of the present disclosure. As shown in FIG. 4, the shape of each transmission electrode 11 includes a linear shape; the linear shape includes multiple segments connected to each other, and the extension directions of at least two segments intersect.

In this embodiment, the shape of each transmission electrode 11 is a linear shape so that the path for transmitting the electrical signals is lengthened, and the influence of the photo-sensitive unit 31 on the electrical signals is increased; further, in the case where the shape of each transmission electrode 11 is a linear shape, the light source may be disposed on one side of the transmission electrodes 11 facing away from the photo-sensitive layer 30. The so-called light source is a structure that emits light (light intensity or wavelength) controlling the dielectric constant of the photo-sensitive unit 31 to change. In this manner, compared with the case where the shape of each transmission electrode 11 is a block shape, the transmission electrodes 11 provided in this embodiment makes the position of the light source flexible.

Figure 5:
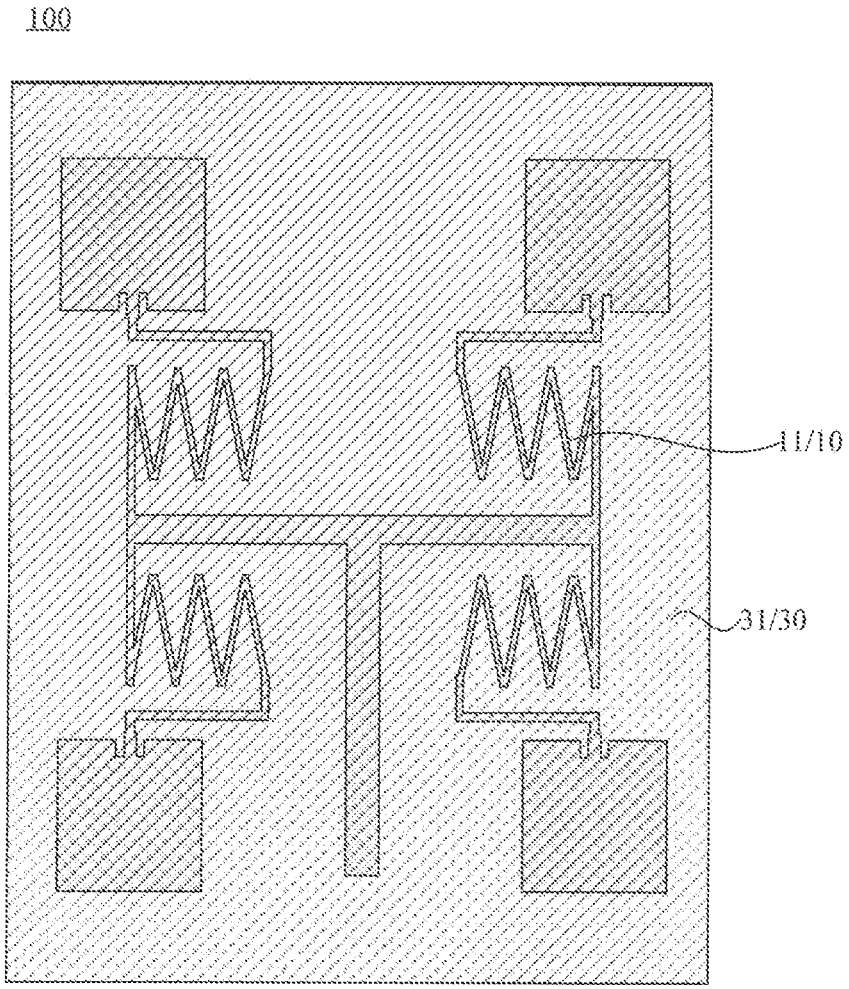
FIG. 5 is a top diagram of another antenna according to an embodiment of the present disclosure.

It is to be noted that in the case where the shape of each transmission electrode 11 is a linear shape, in FIG. 4, the case where the shape of each transmission electrode 11 is serpentine is used as an example and does not constitute a limitation to the present application, and can set it according to the actual condition. In other embodiments, the shape of each transmission electrode 11 may also be a W shape formed by connecting multiple straight line segments as shown in FIG. 5; or a U shape connected to other U shapes (not shown in the figure).

In an embodiment, with continued reference to FIG. 4, in the case where the shape of each transmission electrode 11 is a linear shape, the line width of each transmission electrode 11 is W, where 10 μm≤W≤500 μm.

The advantage of this arrangement is that the normal transmission of the electrical signals in the transmission electrodes 11 is ensured, and at the same time, the following case is avoided: since the line width of each transmission electrode 11 is too great, the photo-sensitive unit 31 below the transmission electrodes 11 is blocked so that the light (light intensity or wavelength) emitted by the light source disposed on one side of the transmission electrodes 11 facing away from the photo-sensitive layer 30 is unable to be irradiated to the photo-sensitive unit 31 below the transmission electrodes 11, and thus the dielectric constant of the photo-sensitive unit 31 is unable to be changed.

Figure 6:
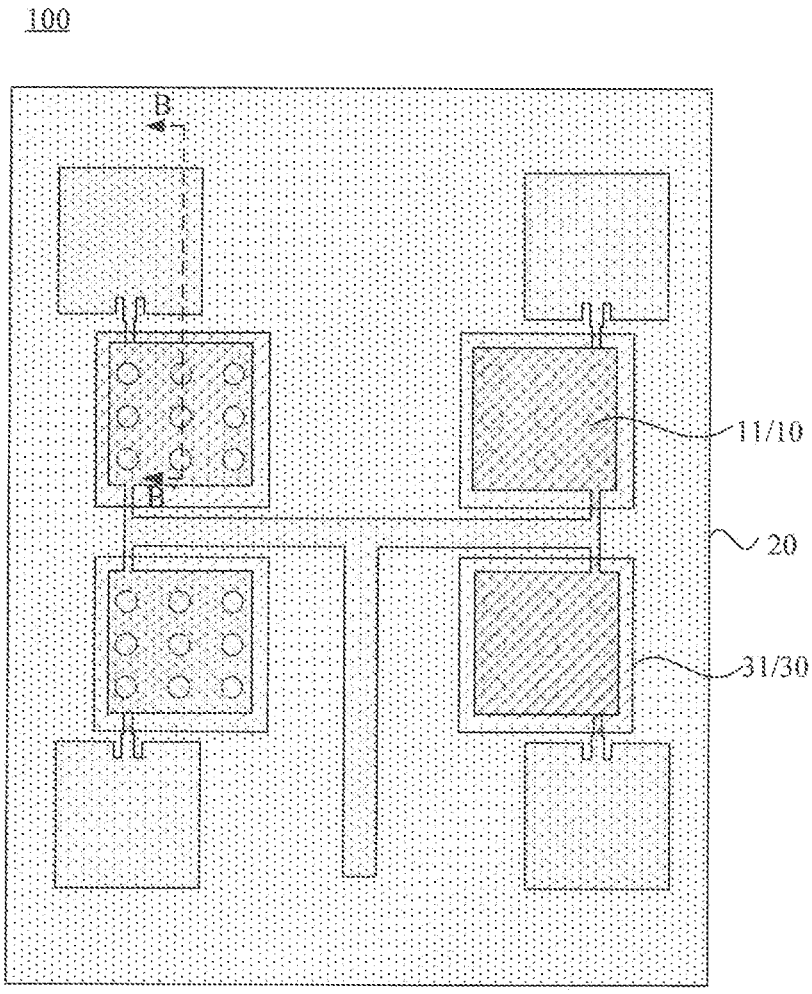
FIG. 6 is a top diagram of another antenna according to an embodiment of the present disclosure.
Figure 7:
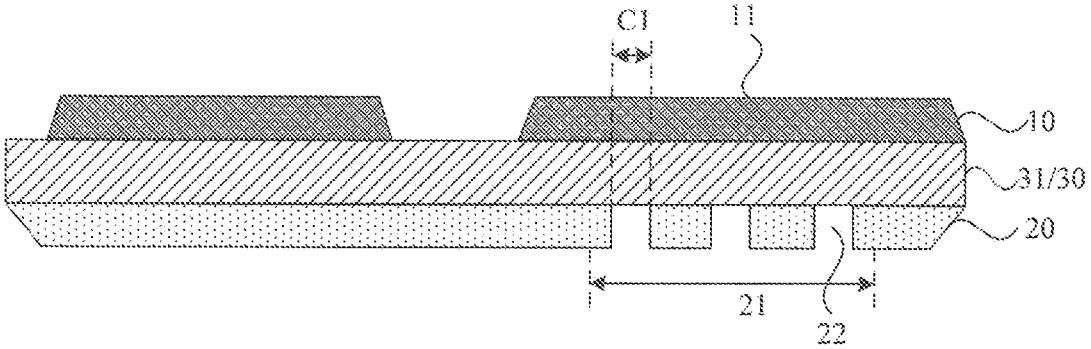
FIG. 7 is a structure diagram of FIG. 6 taken along a B-B' section.

In an embodiment, FIG. 6 is a top diagram of another antenna according to an embodiment of the present disclosure, and FIG. 7 is a structure diagram of FIG. 6 taken along a B-B' section. As shown in FIGS. 6 and 7, the photo-sensitive layer 30 includes multiple photo-sensitive units 31; the second metal electrode 20 includes multiple first hollow regions 21, and each first hollow region 21 includes at least one first hollow structure 22; at least one first hollow structure 22 overlaps the photo-sensitive units 31, and each photo-sensitive unit 31 overlaps the first hollow structure 22.

In this embodiment, each photo-sensitive unit 31 corresponds to at least one first hollow structure 22, and each photo-sensitive unit 31 overlaps the first hollow structure 22. In this manner, the light source may be disposed on one side of the second metal electrode 20 facing away from the photo-sensitive layer 30. In one embodiment, the light (light intensity or wavelength) emitted by the light source is irradiated to the photo-sensitive unit 31 through the first hollow structure 22 so that the dielectric constant of the photo-sensitive unit 31 is controlled to change. In the embodiment, even if the shape of each transmission electrode 11 is a block shape, the dielectric constant of the photo-sensitive unit 31 below the transmission electrodes 11 may be controlled to change.

It is to be understood that in the case where the second metal electrode 20 includes multiple first hollow regions 21 and each first hollow region 21 includes at least one first hollow structure 22, the shape of each transmission electrode 11 is not limited to a block shape. In the case where the shape of each transmission electrode 11 is a linear shape, the same structure may be applied. That is, in the case where the shape of each transmission electrode 11 is a linear shape, the light source may be disposed on one side of the transmission electrodes 11 facing away from the photo-sensitive layer 30; and the light source may also be disposed on one side of the second metal electrode 20 facing away from the photo-sensitive layer 30.

Figure 8:
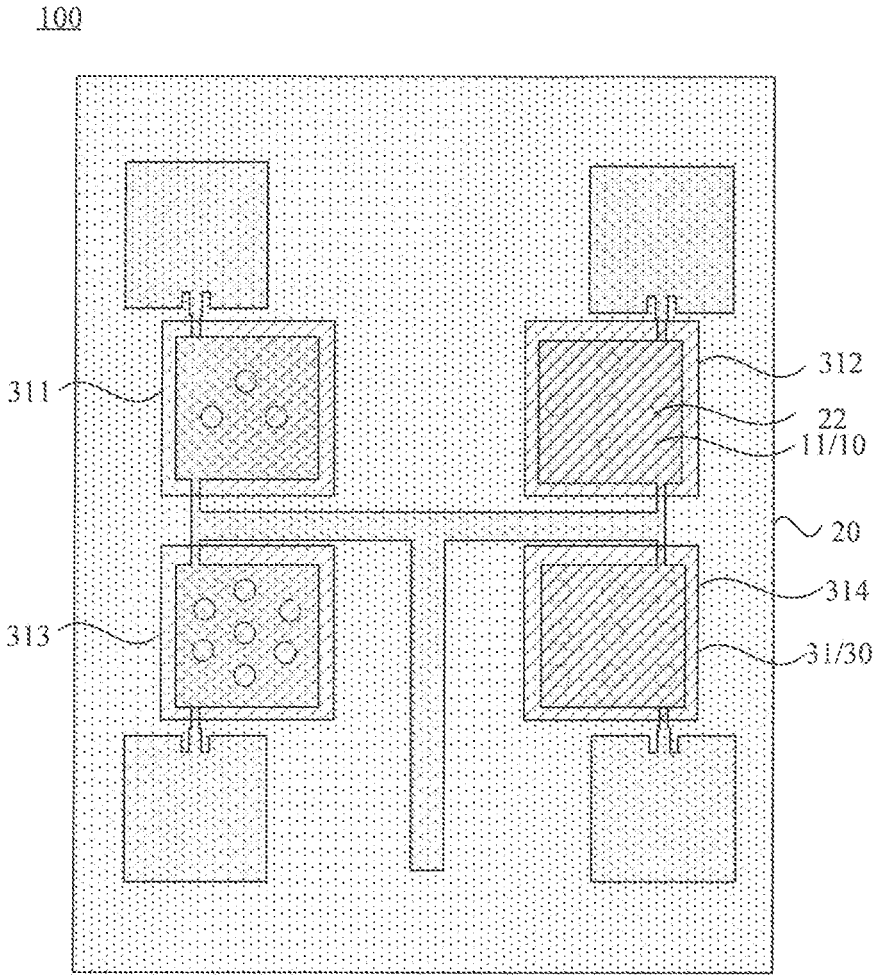
FIG. 8 is a top diagram of another antenna according to an embodiment of the present disclosure.

It is to be noted that in FIG. 6, the case where the photo-sensitive layer 30 includes four photo-sensitive units 31, the second metal electrode 20 includes four first hollow regions 21, and each first hollow region 21 includes nine first hollow structures 22 (that is, the number of the first hollow structures 22 corresponding to each photo-sensitive unit 31 is consistent) is used as an example for description. In other embodiments, the number of the first hollow structures 22 corresponding to each photo-sensitive unit 31 may be inconsistent. In an embodiment, FIG. 8 is a top diagram of another antenna according to an embodiment of the present disclosure. As shown in FIG. 8, four photo-sensitive units 31 include a first photo-sensitive unit 311, a second photo-sensitive unit 312, a third photo-sensitive unit 313, and a fourth photo-sensitive unit 314. The first photo-sensitive unit 311 overlaps three first hollow structures 22, the second photo-sensitive unit 312 overlaps five first hollow structures 22, the third photo-sensitive unit 313 overlaps seven first hollow structures 22, and the fourth photo-sensitive unit 314 overlaps nine first hollow structures 22.

In an embodiment, with continued reference to FIGS. 6 and FIG. 7, the size of each first hollow structure 22 is greater than or equal to 2.5 μm and less than or equal to 25 μm.

In an embodiment, as shown in FIGS. 6 and 7, in the case where the shapes of the first hollow structures 22 include a circle, the diameter C1 of each first hollow structure 22 is, for example, greater than or equal to 2.5 μm and less than or equal to 25 μm. In the case where the shapes of the first hollow structures 22 include a square (not shown in the figure), the size of the side length of each first hollow structure 22 is greater than or equal to 2.5 μm and less than or equal to 25 μm. The size of each first hollow structure 22 is set to be greater than or equal to 2.5 μm and less than or equal to 25 μm. In this manner, the following cases can be avoided: the size of each first hollow structure 22 is too small so that the light emitted by the light source is unable to be irradiated to the photo-sensitive units 31; the first hollow structures 22 are too large so that the electrical signals transmitted by the transmission electrodes 11 are leaked out through the first hollow structures 22.

Figure 9:
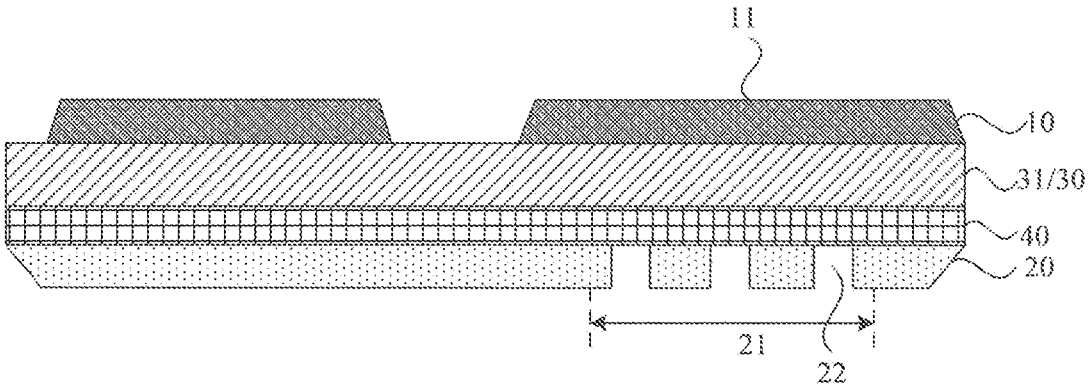
FIG. 9 is a structure diagram of part of film layers of an antenna according to an embodiment of the present disclosure.

In an embodiment, FIG. 9 is a structure diagram of part of film layers of an antenna according to an embodiment of the present disclosure. As shown in FIG. 9, in the case where each photo-sensitive unit 31 overlaps the first hollow structure 22, the antenna 100 provided in embodiments of the present disclosure further includes a light-transmissive conductive layer 40, and the light-transmissive conductive layer 40 is located between the photo-sensitive layer 30 and the second metal electrode 20.

The light-transmissive conductive layer 40 may be, for example, a transparent conductive layer, that is, the light emitted by the light source may be irradiated to the photo-sensitive units 31 through the transparent conductive layer. In this case, the material of the transparent conductive layer may be, for example, indium tin oxide. The light-transmissive conductive layer 40 is not limited to a transparent conductive layer and may also be a conductive layer that only transmits light to which the photo-sensitive unit 31 is able to respond. The so-called light to which the photo-sensitive unit 31 is able to respond may be applied to following case: in the case where the light is irradiated to the photo-sensitive unit 31, the dielectric constant of the photo-sensitive unit 31 is changed. For example, the light to which the photo-sensitive unit 31 is able to respond is a blue light, and the light-transmissive conductive layer 40 may transmit the blue light.

In this embodiment, the light-transmissive conductive layer 40 is provided between the photo-sensitive layer 30 and the second metal electrode 20. The light-transmissive conductive layer 40 is provided so that light may be irradiated to the photo-sensitive unit 31. In this manner, the dielectric constant of the photo-sensitive unit 31 is changed, and the signals transmitted by the transmission electrodes 11 is prevented from leaking out through the first hollow structures 22.

Based on the preceding solutions, the antenna provided in embodiments of the present disclosure further includes at least one layer of base substrate; the base substrate and the photo-sensitive unit are arranged in the same layer; and/or the base substrate and the photo-sensitive unit are arranged in different layers and overlap.

The material of the base substrate may be, for example, one of polyimide, glass, or liquid crystal polymer. It is to be understood that the material of the base substrate includes and is not limited to the preceding examples, and can make a selection according to the actual condition.

In this embodiment, other film layer structures in the antenna may be formed on the base substrate, and the antenna may be supported by, for example, the base substrate.

Figure 10:
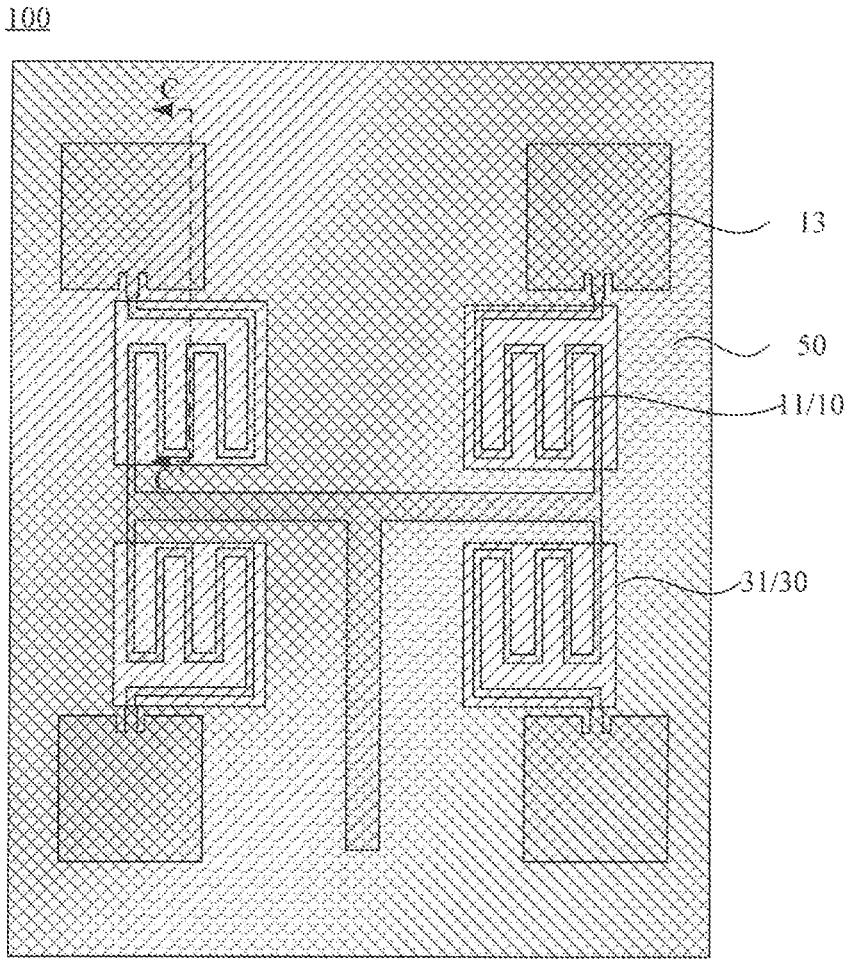
FIG. 10 is a top diagram of another antenna according to an embodiment of the present disclosure.
Figure 11:
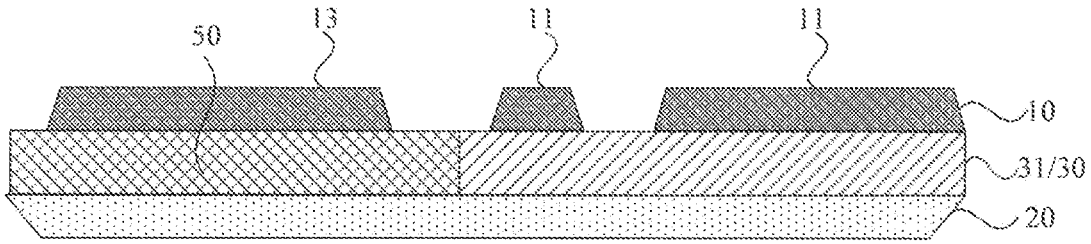
FIG. 11 is a structure diagram of FIG. 10 taken along a C-C' section.

In an embodiment, FIG. 10 is a top diagram of another antenna according to an embodiment of the present disclosure, and FIG. 11 is a structure diagram of FIG. 10 taken along a C-C' section. As shown in FIGS. 10 and 11, the antenna 100 provided in this embodiment includes one layer of base substrate 50, and the base substrate 50 and the photo-sensitive layer 30 are arranged in the same layer. In an embodiment, the preparation steps of the antenna 100 shown in FIG. 10 may be, for example, first, forming the second metal electrode 20 on one support layer (not shown in the figure); then disposing the base substrate 50 on one side of the second metal electrode 20 facing away from the support layer, where the base substrate 50 includes multiple groove structures, and all the multiple groove structures penetrate the base substrate 50; then disposing the photo-sensitive unit 31 in each groove structure; then forming the first metal electrode 10 on one side of the base substrate 50 facing away from the second metal electrode 20. If the antenna 100 includes the support layer, there is no need to peel off the support layer; if the antenna 100 does not need the support layer, the support layer may be peeled off after the first metal electrode 10 is formed as shown in FIGS. 10 and 11.

Figure 12:
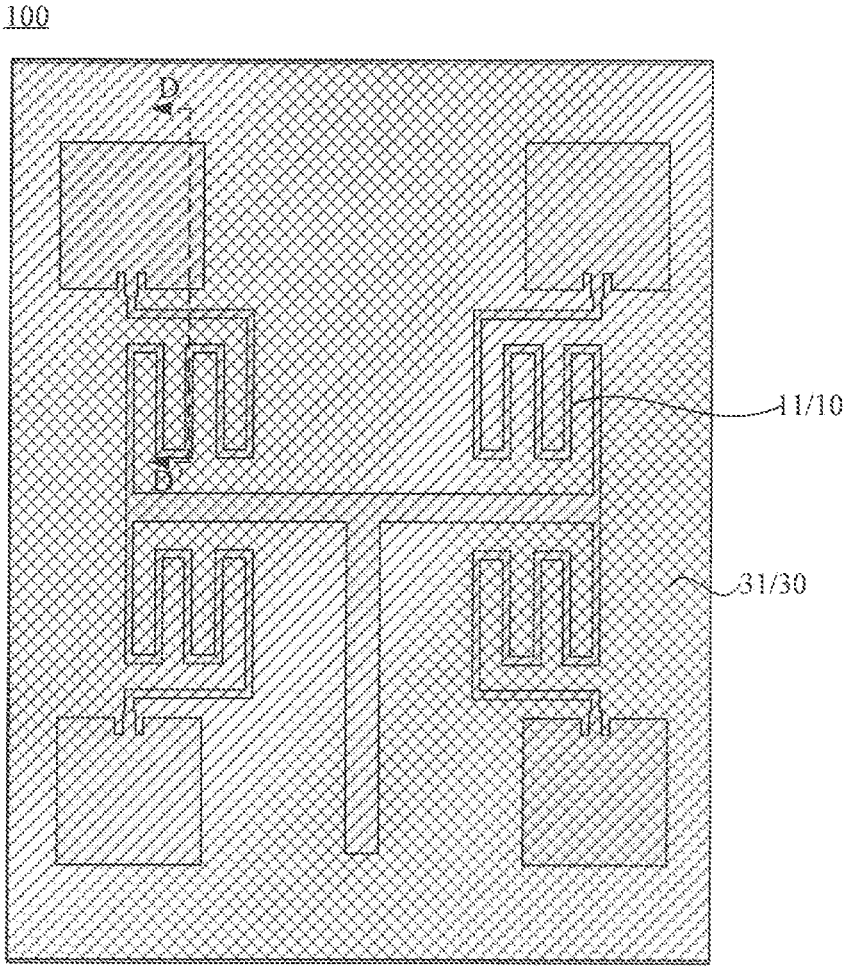
FIG. 12 is a top diagram of another antenna according to an embodiment of the present disclosure.
Figure 13:
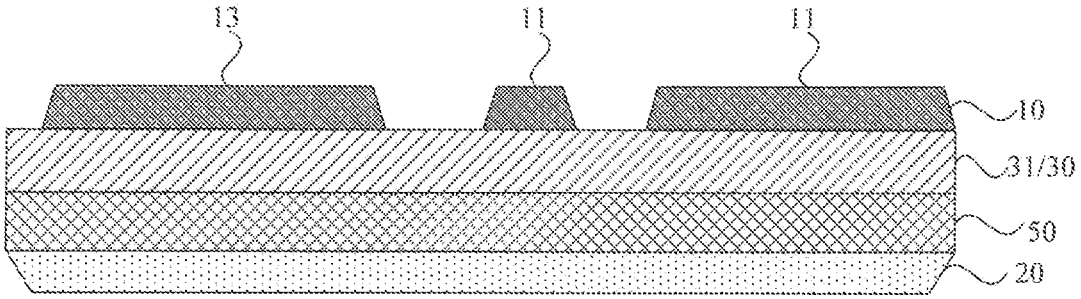
FIG. 13 is a structure diagram of FIG. 12 taken along a D-D' section.

In an embodiment, FIG. 12 is a top diagram of another antenna according to an embodiment of the present disclosure, and FIG. 13 is a structure diagram of FIG. 12 taken along a D-D' section. As shown in FIGS. 12 and 13, the antenna 100 provided in this embodiment includes one layer of base substrate 50, the base substrate 50 is located between the photo-sensitive layer 30 and the second metal electrode 20, and along the thickness direction of the photo-sensitive unit 31, the base substrate 50 overlaps the photo-sensitive unit 31. It is to be noted that the base substrate 50 is a light-transmissive material and may be a light-transmissive organic substrate or a light-transmissive inorganic substrate. In one embodiment, the base substrate 50 may be a glass substrate, or a polyimide substrate, or a polymethyl methacrylate substrate, or a polystyrene substrate.

Figure 14:
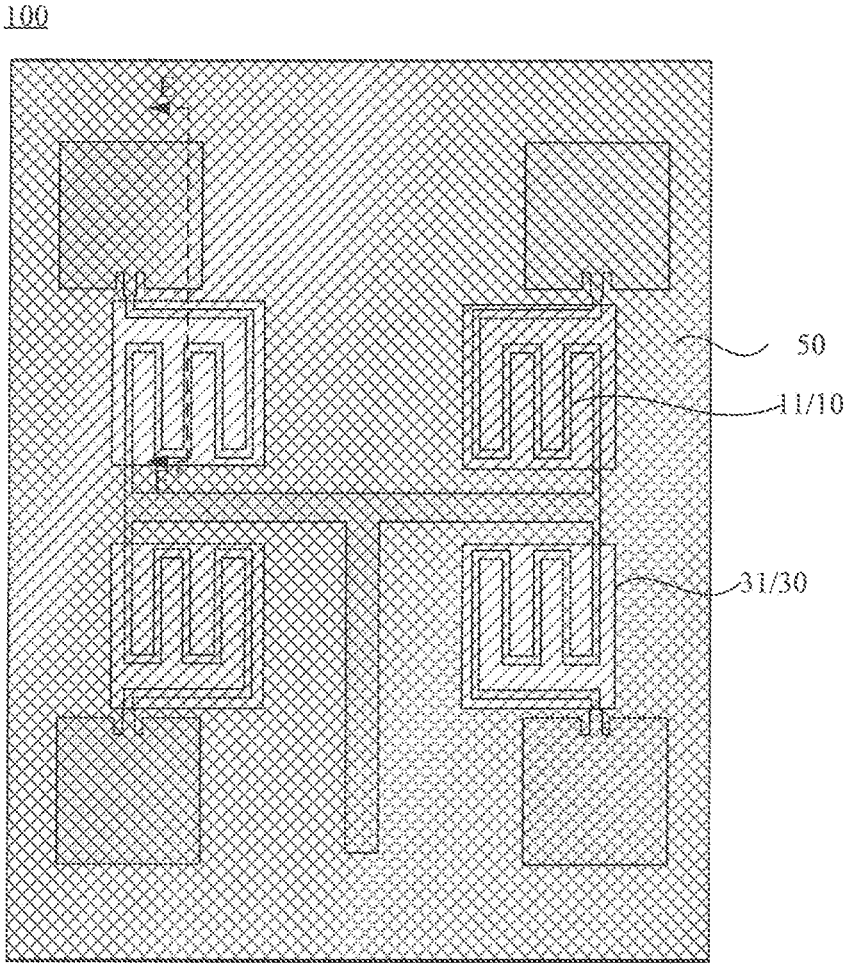
FIG. 14 is a top diagram of another antenna according to an embodiment of the present disclosure.
Figure 15:
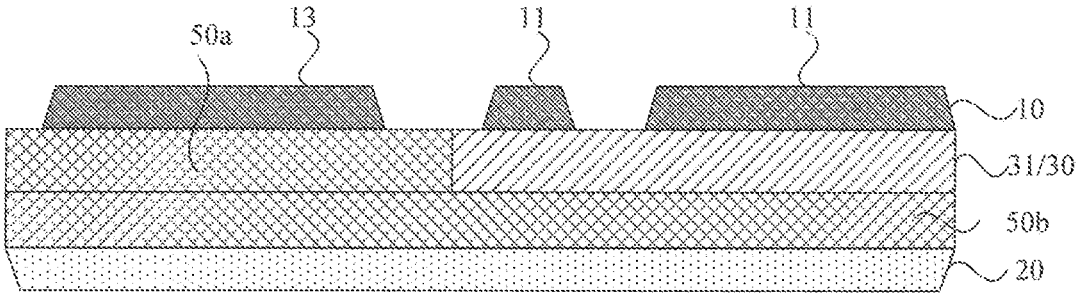
FIG. 15 is a structure diagram of FIG. 14 taken along an E-E' section.

In an embodiment, FIG. 14 is a top diagram of another antenna according to an embodiment of the present disclosure, and FIG. 15 is a structure diagram of FIG. 14 taken along an E-E' section. As shown in FIGS. 14 and 15, the antenna 100 provided in embodiments of the present disclosure further includes two layers of base substrates 50; one base substrate **50*a* and the photo-sensitive unit 31 are arranged in the same layer; the other base substrate 50*b* and the photo-sensitive unit 31** are arranged in different layers and overlap.

It is to be noted that in FIGS. 10, 12, and 14, only the case where the shape of each transmission electrode 11 is a linear shape is used as an example for description and does not constitute a limitation to the present application, and can set it according to the actual condition.

It is to be noted that in the case where the base substrates and the photo-sensitive unit are arranged in the same layer; or the base substrates and the photo-sensitive layer are arranged in different layers and overlap; or one of the base substrates and the photo-sensitive layer are arranged in the same layer; the other base substrate and the photo-sensitive layer are arranged in different layers and overlap, the preceding contents respectively show an example. However, in the case where the antenna further includes at least one layer of base substrate; the specific embodiments in which the base substrate and the photo-sensitive unit are arranged in the same layer; and/or the base substrate and the photo-sensitive unit are arranged in different layers and overlap further includes multiple types. Typical examples will be described below. The following content is based on the example that the shape of each transmission electrode 11 is a linear shape. The following content does not belong to the limitation to the present disclosure.

Figure 16:
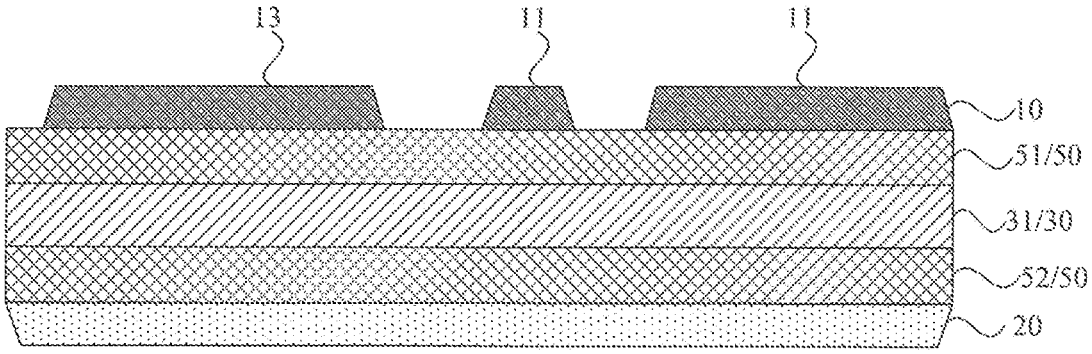
FIG. 16 is a structure diagram of part of film layers of another antenna according to an embodiment of the present disclosure.

In an embodiment, FIG. 16 is a structure diagram of part of film layers of another antenna according to an embodiment of the present disclosure. As shown in FIG. 16, at least one layer of base substrate 50 includes two layers of base substrates; the two layers of base substrates 50 include a first base substrate 51 and a second base substrate 52; the first base substrate 51 and the photo-sensitive layer 30 are arranged in different layers and overlap, the second base substrate 52 and the photo-sensitive layer 30 are arranged in different layers and overlap, and the first base substrate 51 and the second base substrate 52 are respectively located on two sides of the photo-sensitive layer 30. For example, the first base substrate 51 is located between the photo-sensitive layer 30 and the first metal electrode 10, and the second base substrate 52 is located between the photo-sensitive layer 30 and the second metal electrode 20. The antenna provided in this embodiment has a simple structure. In this manner, when the antenna 100 is prepared, the process steps can be simplified and the preparing efficiency of the antenna 100 can be improved.

Figure 17:
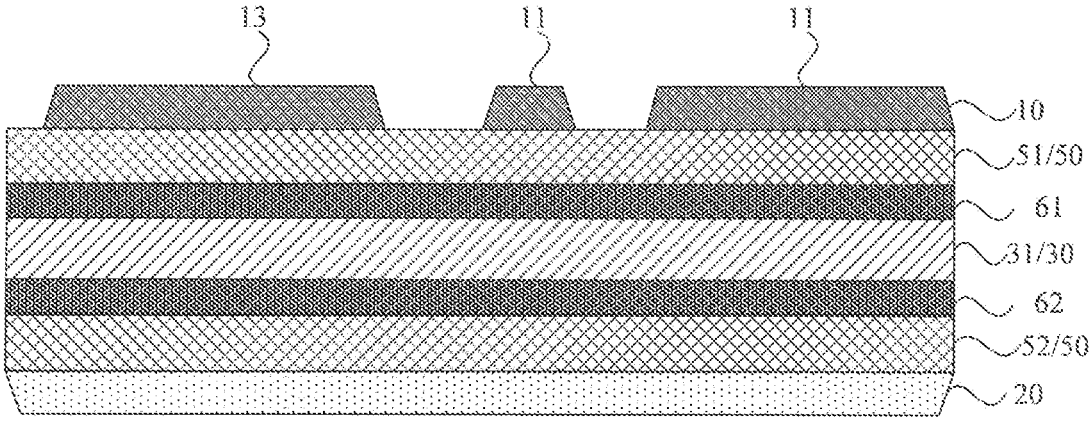
FIG. 17 is a structure diagram of part of film layers of another antenna according to an embodiment of the present disclosure.

In an embodiment, FIG. 17 is a structure diagram of part of film layers of another antenna according to an embodiment of the present disclosure. As shown in FIG. 17, at least one layer of base substrate 50 includes two layers of base substrates; the two layers of base substrates 50 include a first base substrate 51 and a second base substrate 52; the first base substrate 51 and the photo-sensitive layer 30 are arranged in different layers and overlap, the second base substrate 52 and the photo-sensitive layer 30 are arranged in different layers and overlap, and the first base substrate 51 and the second base substrate 52 are respectively located on two sides of the photo-sensitive layer 30; the antenna 100 further includes a first adhesive layer 61 and a second adhesive layer 62; the first adhesive layer 61 is provided between the first base substrate 51 and the photo-sensitive layer 30; the second adhesive layer 62 is provided between the second base substrate 52 and the photo-sensitive layer 30.

The first adhesive layer 61 and the second adhesive layer 62 may include, for example, OC optical glue.

It is to be noted that, in this embodiment, the photo-sensitive layer 30 and the first base substrate 51, and the photo-sensitive layer 30 and the second base substrate 52 are fixed by bonding. In this case, the photo-sensitive layer 30 is a diaphragm structure. Therefore, the photo-sensitive layer 30 is directly bonded to the relatively smooth side of the first base substrate 51 and the relatively smooth side of the second base substrate 52 so that the flatness of the photo-sensitive layer 30 is improved, and thus the thickness of the photo-sensitive layer 30 at the corresponding position of each transmission electrode 11 is consistent.

In an embodiment, the preparation steps of the antenna shown in FIG. 17 may be, for example, first, forming the first metal electrode 10 on the first base substrate 51, and forming the second metal electrode 20 on the second base substrate 52; then bonding the photo-sensitive layer 30 to one side of the second base substrate 52 facing away from the second metal electrode 20 through the second adhesive layer 62; and then bonding the first base substrate 51 to one side of the photo-sensitive layer 30 facing away from the second adhesive layer 62 through the first adhesive layer 61. The first metal electrode 10 on the first base substrate 51 is located on one side of the first adhesive layer 61 facing away from the photo-sensitive layer 30.

It is to be understood that in the case where the antenna is the structure shown in FIG. 17, the preparation steps of the antenna include and are not limited to the preceding examples.

Figure 18:
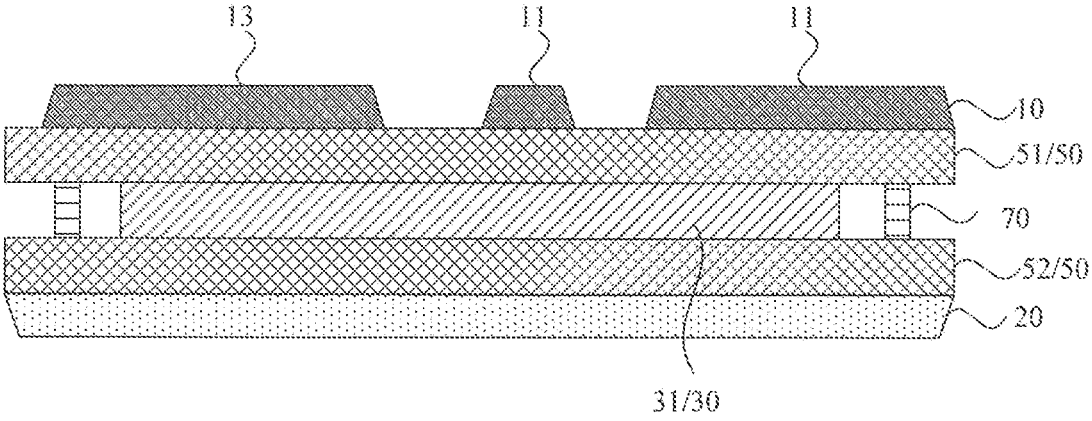
FIG. 18 is a structure diagram of part of film layers of another antenna according to an embodiment of the present disclosure.

In an embodiment, FIG. 18 is a structure diagram of part of film layers of another antenna according to an embodiment of the present disclosure. As shown in FIG. 18, at least one layer of base substrate 50 includes two layers of base substrates; the two layers of base substrates 50 include a first base substrate 51 and a second base substrate 52; the first base substrate 51 and the photo-sensitive layer 30 are arranged in different layers and overlap, the second base substrate 52 and the photo-sensitive layer 30 are arranged in different layers and overlap, and the first base substrate 51 and the second base substrate 52 are respectively located on two sides of the photo-sensitive layer 30; the antenna 100 further includes a frame sealing structure 70, and the frame sealing structure 70 is located between the first base substrate 51 and the second base substrate 52; the first base substrate 51, the second base substrate 52, and the frame sealing structure 70 form an accommodation space, and the photo-sensitive unit 31 is provided in the accommodation space.

The frame sealing structure 70 may be, for example, frame sealing glue. The frame sealing glue is sticky, has strong plasticity under the normal condition, and has mechanical properties when cured through light or other manners. Therefore, the first base substrate 51 and the second base substrate 52 may be sealed by the frame sealing glue. In this manner, in the case where the photo-sensitive unit 31 is in a fluid state, the photo-sensitive unit 31 can be prevented from leaking.

In this embodiment, the accommodation space is formed by the first base substrate 51, the second base substrate 52, and the frame sealing structure 70, and the photo-sensitive unit 31 is disposed in the accommodation space. In this case, the photo-sensitive unit 31 may be in a fluid state or in a solid state. In this manner, the selection range of the material of the photo-sensitive unit 31 may be expanded, and the material of the photo-sensitive unit 31 may be selected more flexibly.

Figure 19:
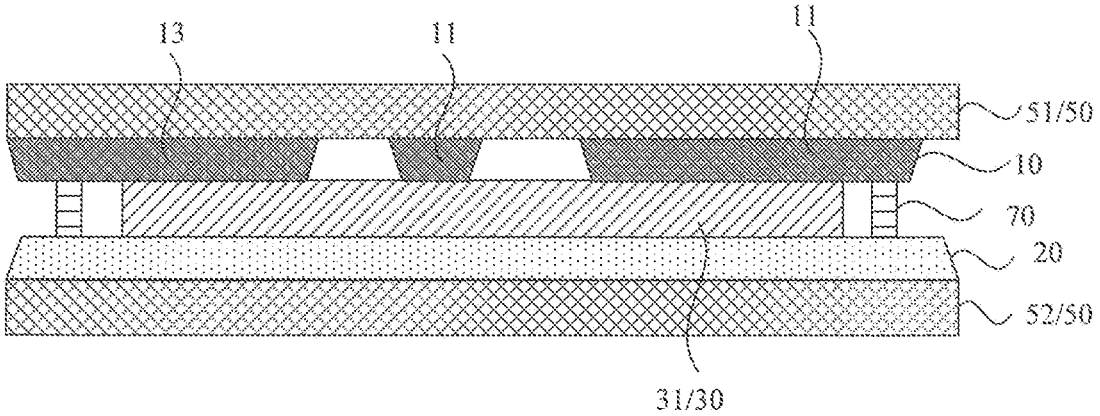
FIG. 19 is a structure diagram of part of film layers of another antenna according to an embodiment of the present disclosure.

In an embodiment, FIG. 19 is a structure diagram of part of film layers of another antenna according to an embodiment of the present disclosure. As shown in FIG. 19, unlike FIG. 18, in FIG. 19, the first base substrate 51 is located on one side of the first metal electrode 10 farther from the photo-sensitive layer 30; the second base substrate 52 is located on one side of the second metal electrode 20 farther from the photo-sensitive layer 30. In FIG. 18, the first base substrate 51 is located on one side of the first metal electrode 10 closer to the photo-sensitive layer 30; the second base substrate 52 is located on one side of the second metal electrode 20 closer to the photo-sensitive layer 30.

In an embodiment, the preparation steps of the antenna shown in FIGS. 18 and 19 may be, for example, forming the first metal electrode 10 on the first base substrate 51 and forming the second metal electrode 20 on the second base substrate 52; bonding the first base substrate 51 on which the first metal electrode 10 is formed and the second base substrate 52 on which the second metal electrode 20 is formed in an aligned manner to form an accommodation space so that the frame sealing structure 70 and the photo-sensitive unit 31 are located between the first base substrate 51 and the second base substrate 52, and the frame sealing structure 70 is disposed around the photo-sensitive unit 31.

In the embodiment of FIG. 19, the first metal electrode 10 is located on one side of the first base substrate 51 closer to the photo-sensitive unit 31 so that the loss of signal transmission can be further reduced; at the same time, the thickness of the first base substrate 51 does not need to be limited and the process requirements can be reduced.

Figure 20:
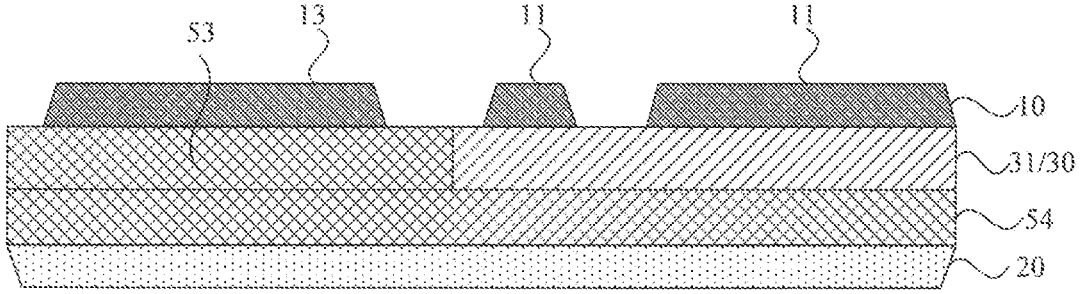
FIG. 20 is a structure diagram of part of film layers of another antenna according to an embodiment of the present disclosure.

In an embodiment, FIG. 20 is a structure diagram of part of film layers of another antenna according to an embodiment of the present disclosure. As shown in FIG. 20, at least one layer of base substrate 50 includes two layers of base substrates; the two layers of base substrates 50 include a third base substrate 53 and a fourth base substrate 54; the third base substrate 53 and the photo-sensitive layer 30 are arranged in the same layer, and the fourth base substrate 54 is located on one side of the photo-sensitive layer 30; the material of the third base substrate 53 includes polyimide, and the material of the fourth base substrate 54 includes glass or liquid crystal polymer.

In an embodiment, the preparation steps of the antenna shown in FIG. 20 may be, for example, providing one fourth base substrate 54, where the fourth base substrate 54 is a rigid substrate, the material of the fourth base substrate 54 may be, for example, glass or liquid crystal polymer, other film layers of the antenna are provided on the fourth base substrate 54, and the support layer does not need to be disposed individually; then coating polyimide on the fourth base substrate 54 by, for example, a coating process and performing curing to form the third base substrate 53; then grooving the third base substrate 53 to form multiple groove structures, where for example, the multiple groove structures penetrate the third base substrate 53; then disposing the photo-sensitive unit 31 in each groove structure; then forming the second metal electrode 20 on the fourth base substrate 54, and forming the first metal electrode 10 on the third base substrate 53. Since the fourth base substrate 54 is a rigid substrate (glass or liquid crystal polymer) and the material of the third base substrate 53 is polyimide, the polyimide may be directly coated on the fourth base substrate 54 by a coating process. In this case, a glue layer does not need to be disposed between the third base substrate 53 and the fourth base substrate 54 so that which the process steps can be simplified and the manufacturing cost of the antenna can be reduced.

Figure 21:
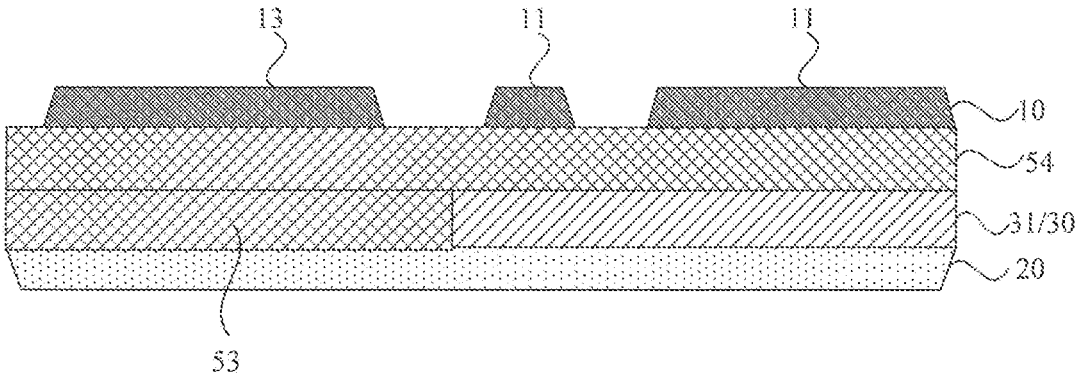
FIG. 21 is a structure diagram of part of film layers of another antenna according to an embodiment of the present disclosure.

It is to be noted that, in FIG. 20, the case where the fourth base substrate 54 is located on one side of the photo-sensitive layer 30 facing away from the first metal electrode 10 is used as an example. In other embodiments, the fourth base substrate 54 may also be located on one side of the photo-sensitive layer 30 closer to the first metal electrode 10. For example, referring to FIG. 21, in this case, a glue layer does not need to be disposed between the third base substrate 53 and the fourth base substrate 54.

Figure 22:
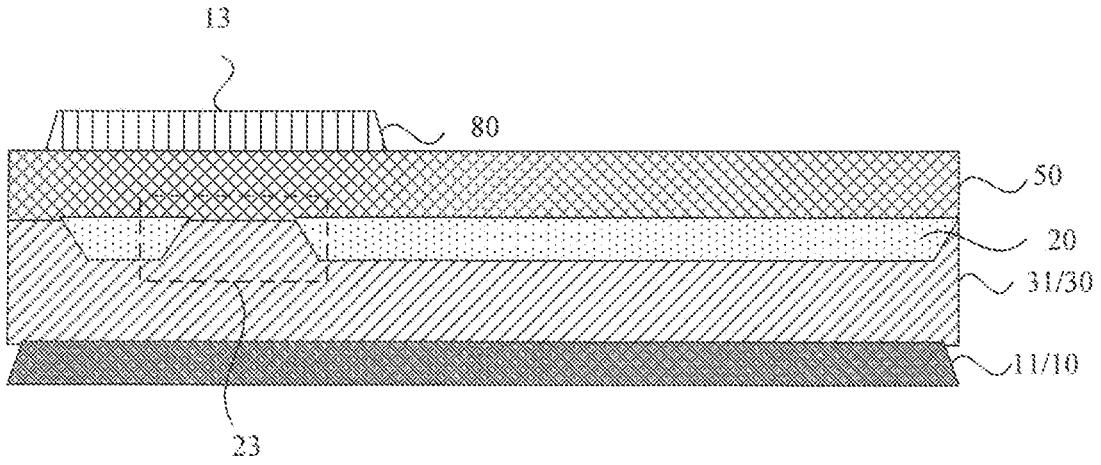
FIG. 22 is a structure diagram of part of film layers of another antenna according to an embodiment of the present disclosure.

In an embodiment, FIG. 22 is a structure diagram of part of film layers of another antenna according to an embodiment of the present disclosure. As shown in FIG. 22, the base substrate 50 and the photo-sensitive unit 31 are arranged in different layers and overlap; the base substrate 50 is located on one side of the second metal electrode 20 facing away from the first metal electrode 10; the second metal electrode 20 includes multiple second hollow structures 23, and the vertical projection of each second hollow structure 23 on the plane where the base substrate 50 is located is within the vertical projection of a respective transmission electrode 11 on the plane where the base substrate 50 is located; the antenna further includes a third metal electrode 80, and the third metal electrode 80 is located on one side of the base substrate 50 facing away from the second metal electrode 20; the third metal electrode 80 includes multiple radiators 13; the vertical projection of each second hollow structure 23 on the plane where the base substrate 50 is located is within the vertical projection of a respective radiator 13 on the plane where the base substrate 50 is located.

In the case where the antenna is the structure shown in FIG. 22, the working principle of the antenna is: the electrical signals are transmitted in the transmission electrodes 11; at the same time, the dielectric constant of the photo-sensitive unit 31 is affected by the light intensity or wavelength and thus changed, and the phase shift of the electrical signals transmitted in the transmission electrodes 11 is performed. In this manner, the phases of the electrical signals are changed, finally the electrical signals are coupled to the radiators 13 at the second hollow structures 23 of the second metal electrode 20, and the radiators 13 radiate the signals outward. It is to be noted that the multiple radiators 13 are multiple independent radiators 13, and each radiator 13 radiates a signal outward. In this embodiment, since the radiators 13 and the transmission electrodes 11 are located in different film layers so that the wiring arrangement of the transmission electrodes 11 is easy and the process difficulty is reduced, which is conducive to disposing more radiators 13.

In an embodiment, with continued reference to FIG. 22, in the structure, the photo-sensitive unit 31 may be formed on one side of the base substrate 50 where the second metal electrode 20 is disposed by a coating process. Further, after the coated photo-sensitive material is cured in a certain manner, the surface of the photo-sensitive material may further be provided with the first metal electrode 10. The curing manners may be static, light curing, or thermal curing, which needs to be determined according to the property of the photo-sensitive material.

In the preceding embodiments, in the case where the base substrate 50 and the photo-sensitive unit 31 are arranged in different layers and overlap, the base substrate 50 includes a light-transmissive base substrate. The advantage of this arrangement is that the light emitted by the light source may be irradiated to the photo-sensitive unit 51 through the light-transmissive base substrate 50; at the same time, the antenna may be supported.

Figure 23:
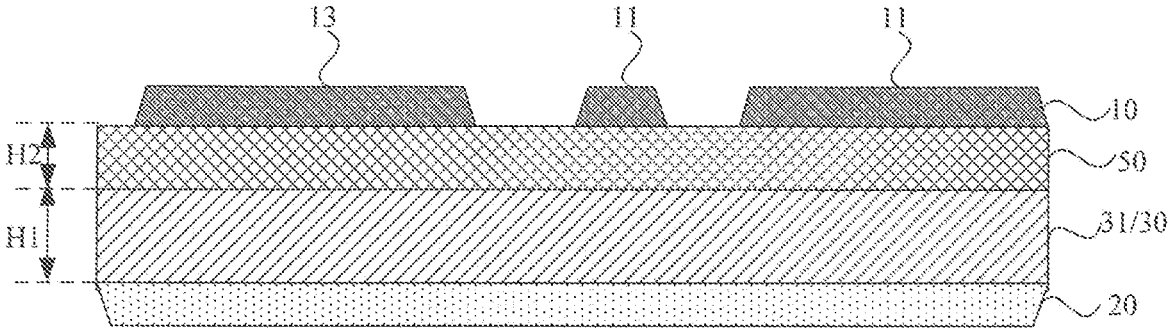
FIG. 23 is a structure diagram of part of film layers of another antenna according to an embodiment of the present disclosure.

In the preceding embodiments, FIG. 23 is a structure diagram of part of film layers of another antenna according to an embodiment of the present disclosure. In the case where the base substrate 50 and the photo-sensitive unit 31 are arranged in different layers and overlap, the thickness H1 of the photo-sensitive unit 31 is greater than the thickness H2 of the base substrate 50. In this manner, the influence of the photo-sensitive unit 31 on the electrical signals is increased.

It is to be noted that in FIG. 23, only the case where the antenna includes one layer of base substrate 50, and the base substrate 50 is located between the photo-sensitive layer 30 and the first metal electrode 10 is used as an example for description, which does not constitute a limitation to the present application. As long as the antenna includes the base substrate 50, and the base substrate 50 and the photo-sensitive unit 31 are arranged in different layers and overlap, the preceding thickness relationship may be satisfied.

In the preceding embodiments, referring to FIGS. 10 and 11, the base substrate 50 and the photo-sensitive unit 31 are arranged in the same layer; the first metal electrode 10 further includes multiple radiators 13; the vertical projection of each radiator 13 on the plane where the base substrate 50 is located is within the base substrate 50. The advantage of this arrangement is that the problem that in the case where the electrical signals are radiated outward through the radiators 13, it is difficult for the radiators 13 to radiate the electrical signals outward due to the phase change can be avoided.

It is to be noted that in FIGS. 10 and 11, only the case where the antenna includes one layer of base substrate 50 is used as an example for description, which does not constitute a limitation to the present application. As long as the antenna includes the base substrate 50, and the base substrate 50 and the photo-sensitive unit 31 are arranged in the same layer, the preceding positional relationship may be satisfied.

Figure 24:
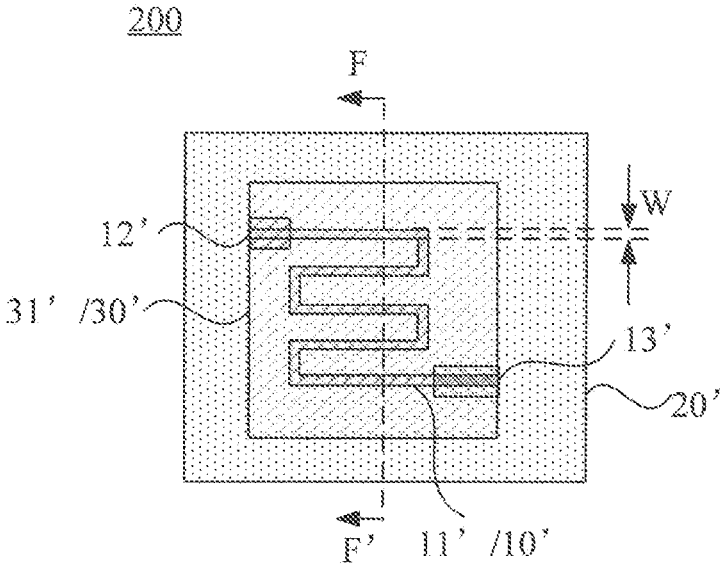
FIG. 24 is a top diagram of a phase shifter according to an embodiment of the present disclosure.
Figure 25:
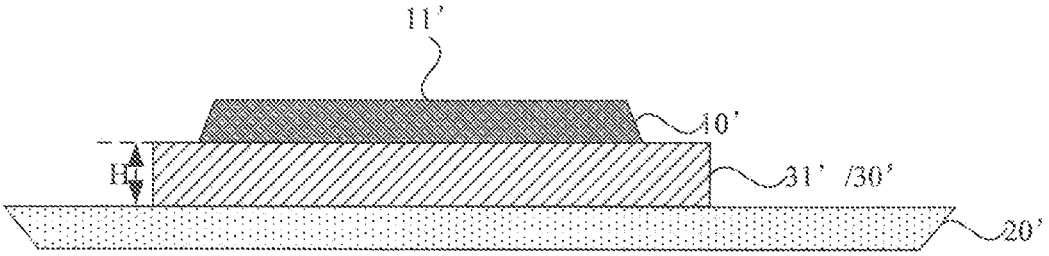
FIG. 25 is a structure diagram of FIG. 24 taken along an F-F' section.

Based on the same concept, embodiments of the present disclosure further provide a phase shifter. FIG. 24 is a top diagram of a phase shifter according to an embodiment of the present disclosure, and FIG. 25 is a structure diagram of FIG. 24 taken along an F-F' section. As shown in FIGS. 24 and 25, a phase shifter 200 provided in embodiments of the present disclosure includes a first metal electrode 10', a second metal electrode 20', and a photo-sensitive layer 30'; the first metal electrode 10' and the second metal electrode 20' are respectively located on two opposite sides of the photo-sensitive layer 30'; the first metal electrode 10' includes multiple transmission electrodes 11'; the multiple transmission electrodes 11' are configured to transmit electrical signals; the photo-sensitive layer 30' includes at least one photo-sensitive unit 31' and the at least one photo-sensitive unit 31' overlaps the transmission electrodes 11'. In FIG. 24, only the case where the photo-sensitive layer 30' includes one photo-sensitive unit 31' is used as an example for description.

For example, the dielectric constant of the photo-sensitive unit 31' may be controlled to change by controlling the light intensity; the dielectric constant of the photo-sensitive unit 31' may also be controlled to change by using the wavelength, which is not limited in this embodiment as long as the dielectric constant of the photo-sensitive unit 31' is changed.

In an embodiment, the transmission electrodes 11' are configured to transmit electrical signals, and the second metal electrode 20' is provided with a fixed potential. For example, the second metal electrode 20' is grounded. During the transmission of electrical signals, the dielectric constant of the photo-sensitive unit 31' is affected by the light intensity or wavelength and thus changed so that the capacitance value of the capacitor formed between the transmission electrodes 11' and the second metal electrode 20' is changed, and the phase shift of the electrical signals transmitted in the transmission electrodes 11' is performed. In this manner, the phases of the electrical signals are changed, and the phase shift function of the electrical signals is achieved. The transmission electrodes 11' are configured to transmit electrical signals, and the phase shift of the electrical signals is performed during the transmission process. A first feeder terminal 12' and a second feeder terminal 13' are configured to cooperate with two ends of each transmission electrode 11' to achieve the feed-in and feed-out of the electrical signals in the transmission electrode 11'.

This embodiment does not limit the material of the photo-sensitive unit 31'. In some embodiments can make a selection according to the actual condition as long as through the change of the dielectric constant of the photo-sensitive unit 31', the phase shift of the electrical signals transmitted in the transmission electrodes 11' is performed, and the phases of the electrical signals are changed. In an embodiment, the material of the photo-sensitive unit 31' may include azo dye or azo polymer.

It is to be understood that the photo-sensitive unit 31' overlaps the transmission electrodes 11'. It is feasible that the photo-sensitive unit 31' may partially overlap the transmission electrodes 11'; it is also feasible that the region where the transmission electrodes 11' are located coincide with the region where the photo-sensitive unit 31' is located; it is also feasible that the transmission electrodes 11' are located in the projection of the photo-sensitive unit 31'. It is also to be understood that the photo-sensitive unit 31' overlaps the transmission electrodes 11', and it is feasible that in the thickness direction of the photo-sensitive unit 31', the photo-sensitive unit 31' overlaps the transmission electrodes 11'. In an embodiment, in the case where the transmission electrodes 11' are planar transmission electrodes, the photo-sensitive unit 31' overlaps the transmission electrodes 11', and it is feasible that the vertical projection of the photo-sensitive unit 31' on a plane where the transmission electrodes 11' are located overlaps the transmission electrodes 11'.

Figure 26:
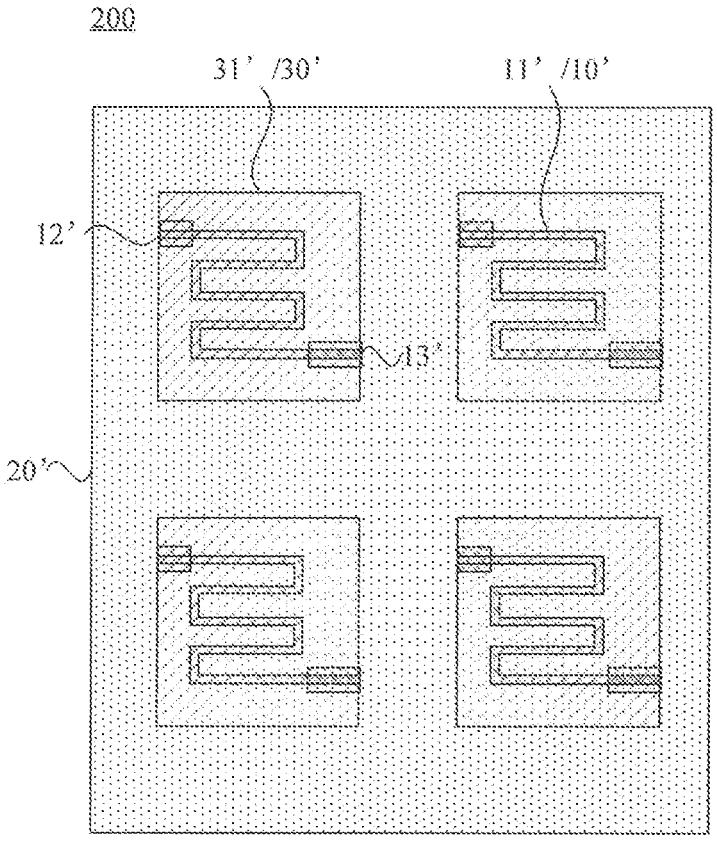
FIG. 26 is a top diagram of another phase shifter according to an embodiment of the present disclosure.
Figure 27:
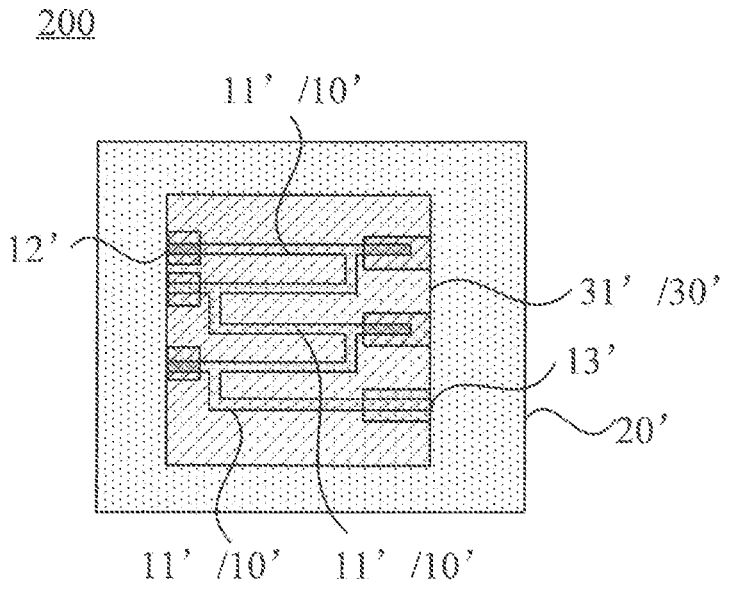
FIG. 27 is a top diagram of another phase shifter according to an embodiment of the present disclosure.

It is to be noted that, in FIG. 24, the case where the phase shifter 200 includes one transmission electrode 11' and one photo-sensitive unit 31' is used as an example for description. In other embodiments, the phase shifter 200 may further include multiple photo-sensitive units 31', and the multiple photo-sensitive units 31' and the multiple transmission electrodes 11' are arranged in a one-to-one correspondence; or the phase shifter 200 includes multiple transmission electrodes 11', and the multiple transmission electrodes 11' correspond to one photo-sensitive unit 31'. In an embodiment, FIG. 26 is a top diagram of another phase shifter according to an embodiment of the present disclosure. As shown in FIG. 26, the photo-sensitive layer 30' includes four photo-sensitive units 31', and each photo-sensitive unit 31' corresponds to and overlaps with a respective one of the multiple transmission electrodes 11'. FIG. 27 is a top diagram of another phase shifter according to an embodiment of the present disclosure. As shown in FIG. 27, the phase shifter 200 includes three transmission electrodes 11', the three transmission electrodes 11' correspond to one photo-sensitive unit 31', and all the three transmission electrodes 11' overlap the photo-sensitive unit 31'.

In the phase shifter provided in the present application, since the signals are changed by using the change of the dielectric constant of the photo-sensitive layer 30' and the change of the dielectric constant of the photo-sensitive layer 30' is generated by the stimulation of the light source, comparing with the related art in which the phases of the electrical signals are changed through a liquid crystal layer, in the present application, there is no need to provide driving electrodes to control the dielectric constant of the liquid crystal layer to change. Therefore, as for the phase shifter, the manufacturing of driving electrodes can be avoided in the manufacturing process so that the production cost can be further reduced.

In an embodiment, with continued reference to FIG. 25, the thickness of the photo-sensitive layer 30' is H, that is, the thickness of the photo-sensitive unit 31' is H, where 10 μm≤1000 μm.

The thickness of the photo-sensitive unit 31' is set between 10 μm and 100 μm, that is, the following cases are avoided: since the thickness of the photo-sensitive unit 31' is too great, the loss of the electrical signals transmitted by the transmission electrodes 11' occurs in the photo-sensitive unit 31'; and since the thickness of the photo-sensitive unit 31' is too small, the bandwidths of the electrical signals are too narrow and the application of the phase shifter is limited. For example, the bandwidths of the electrical signals transmitted to the transmission electrodes 11' is between 5 GHz±0.5 GHz, that is, between 4.5 GHz and 5.5 GHz. Under the same structure, if the thickness of the photo-sensitive unit 31' is too small, the frequencies of the electrical signals transmitted by the transmission electrodes 11' are only between 5 GHz±0.2 GHz, that is, between 4.8 GHz and 5.2 GHz. In this manner, the bandwidths of the electrical signals are narrowed, and part of the electrical signals are lost so that the application of the phase shifter is limited; further, if the thickness of the photo-sensitive unit 31' is too small, the influence of the process fluctuation on the thickness of the photo-sensitive unit 31' is increased, the influence of the process fluctuation on the capacitance value of the capacitor formed between the transmission electrodes 11' and the second metal electrode 20' is increased, and thus the phase shift of the electrical signals transmitted in the transmission electrodes 11' is affected. Therefore, in this embodiment, the thickness of the photo-sensitive unit 31' is set between 10 μm and 100 μm so that while the normal transmission of the electrical signals is ensured, the application range of the phase shifter is also expanded and the phase shift of the electrical signals transmitted in the transmission electrodes 11' is ensured.

In an embodiment, the electrical signals transmitted by the transmission electrodes 11' may be, for example, high-frequency signals. The frequencies of the high-frequency signals are, for example, greater than or equal to 1 GHz. In this manner, the phase shifter may be applied to long-distance and high-speed transmission devices such as satellites and base stations. Moreover, the manufacturing of driving electrodes in the manufacturing process of the phase shifter can be avoided, that is, the production cost can be reduced. Therefore, the phase shifter has high commercial application value.

It is to be understood that the electrical signals transmitted by the transmission electrodes 11' include and are not limited to the preceding examples.

To sum up, in the phase shifter provided in embodiments of the present disclosure, the photo-sensitive layer is disposed between the first metal electrode and the second metal electrode, and the phase shift of the electrical signals transmitted by the transmission electrodes is controlled by controlling the dielectric constant of the photo-sensitive layer. This new type of phase shifter provides more possibilities for large-scale commercialization.

In an embodiment, with continued reference to FIG. 24, the shape of each transmission electrode 11' includes a linear shape; the linear shape includes multiple segments connected to each other, and the extension directions of at least two segments intersect.

In this embodiment, the shape of each transmission electrode 11' is a linear shape so that the path for transmitting the electrical signals is lengthened, and the influence of the photo-sensitive unit 31' on the electrical signals is increased; further, in the case where the shape of each transmission electrode 11' is a linear shape, the light source may be disposed on one side of the transmission electrodes 11' facing away from the photo-sensitive layer 30'. The so-called light source is a structure that emits light (light intensity or wavelength) controlling the dielectric constant of the photo-sensitive unit 31' to change. In this manner, the position of the light source is flexible.

Figure 28:
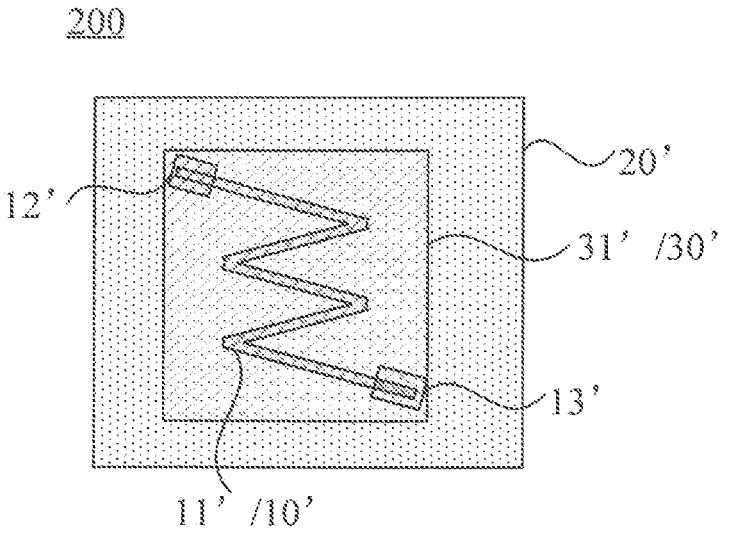
FIG. 28 is a top diagram of another phase shifter according to an embodiment of the present disclosure.

It is to be noted that in the case where the shape of each transmission electrode 11' is a linear shape, in FIG. 24, the case where the shape of each transmission electrode 11' is serpentine is used as an example and does not constitute a limitation to the present application, and can set it according to the actual condition. In other embodiments, the shape of each transmission electrode 11' may also be a W shape formed by connecting multiple straight line segments as shown in FIG. 28; or a U shape connected to other U shapes (not shown in the figure).

In an embodiment, with continued reference to FIG. 24, in the case where the shape of each transmission electrode 11' is a linear shape, the line width of each transmission electrode 11' is W, where 10 μm≤W≤500 μm.

The advantage of this arrangement is that the normal transmission of the electrical signals in the transmission electrodes 11' is ensured, and at the same time, the following case is avoided: since the line width of each transmission electrode 11' is too great, the photo-sensitive unit 31' below the transmission electrodes 11' is blocked so that the light (light intensity or wavelength) emitted by the light source disposed on one side of the transmission electrodes 11' facing away from the photo-sensitive layer 30' is unable to be irradiated to the photo-sensitive unit 31' below the transmission electrodes 11', and thus the dielectric constant of the photo-sensitive unit 31' is unable to be changed.

Figure 29:
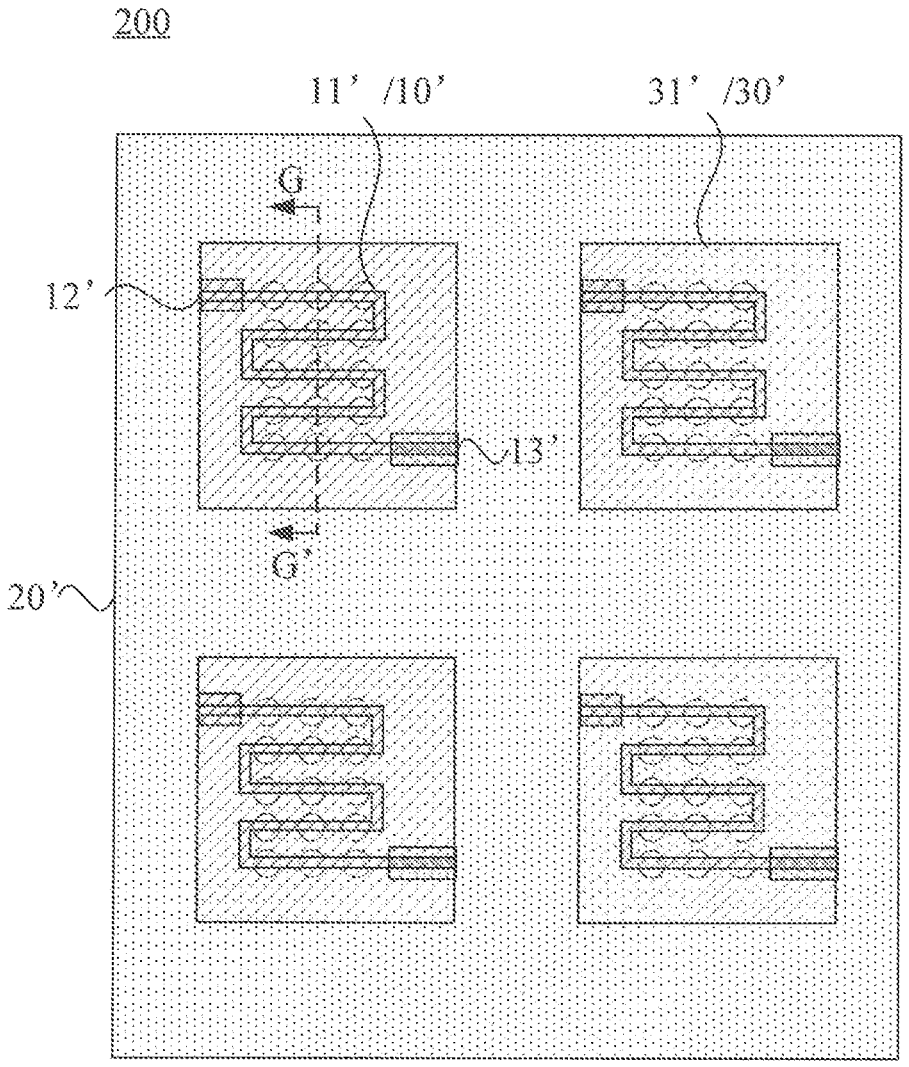
FIG. 29 is a top diagram of another phase shifter according to an embodiment of the present disclosure.
Figure 30:
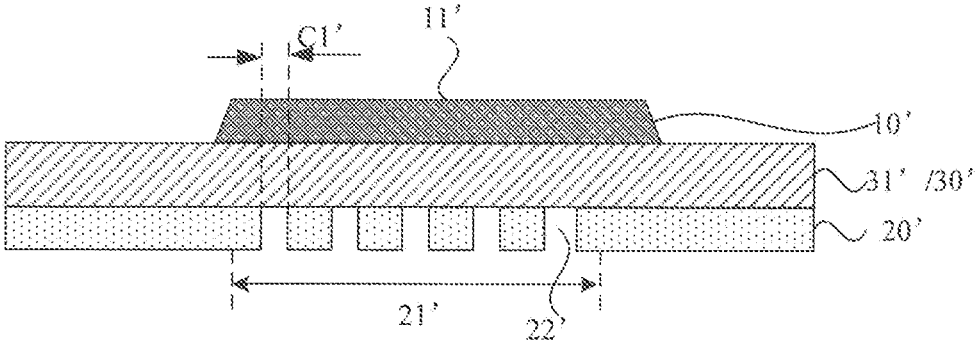
FIG. 30 is a structure diagram of FIG. 29 taken along a G-G' section.

In an embodiment, FIG. 29 is a top diagram of another phase shifter according to an embodiment of the present disclosure, and FIG. 30 is a structure diagram of FIG. 29 taken along a G-G' section. As shown in FIGS. 29 and 30, the photo-sensitive layer 30' includes multiple photo-sensitive units 31'; the second metal electrode 20' includes multiple first hollow regions 21', and each first hollow region 21' includes at least one first hollow structure 22'; at least one first hollow structure 22' overlaps the photo-sensitive units 31', and each photo-sensitive unit 31' overlaps the first hollow structure 22'.

In this embodiment, each photo-sensitive unit 31' corresponds to at least one first hollow structure 22', and each photo-sensitive unit 31' overlaps the first hollow structure 22'. In this manner, the light source may be disposed on one side of the second metal electrode 20' facing away from the photo-sensitive layer 30'. The light (light intensity or wavelength) emitted by the light source is irradiated to the photo-sensitive unit 31' through the first hollow structure 22' so that the dielectric constant of the photo-sensitive unit 31' is controlled to change. In the embodiment, the light source may be disposed on one side of the transmission electrodes 11' facing away from the photo-sensitive layer 30'; the light source may also be disposed on one side of the second metal electrode 20' facing away from the photo-sensitive layer 30'. That is, the position of the light source is flexible.

Figure 31:
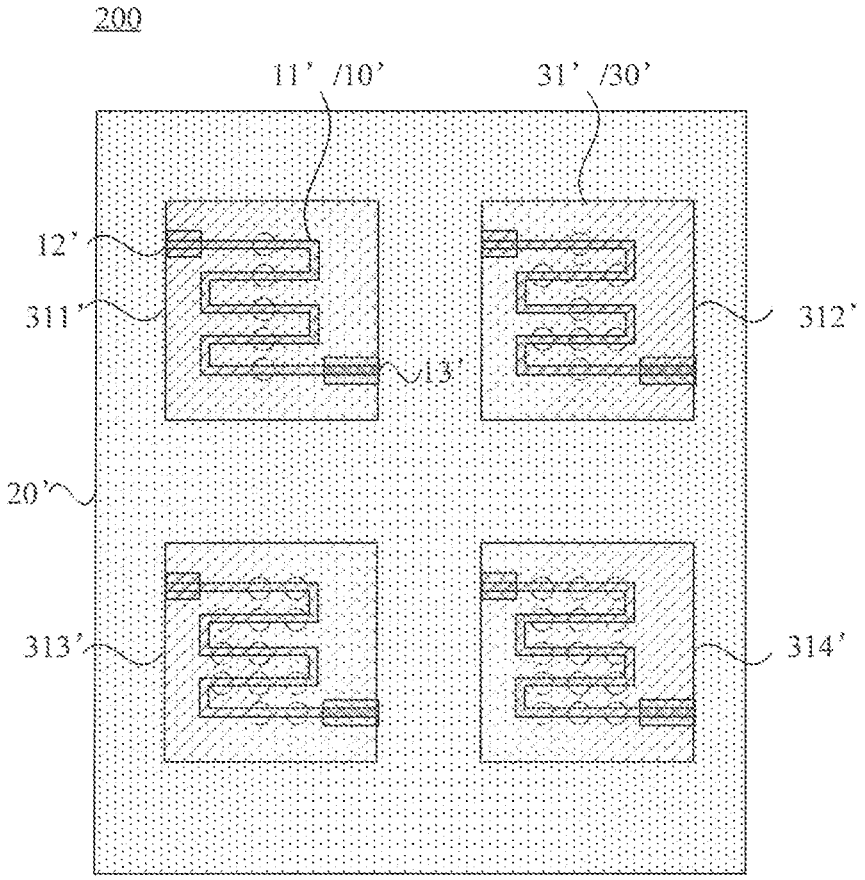
FIG. 31 is a top diagram of another phase shifter according to an embodiment of the present disclosure.

It is to be noted that in FIG. 29, the case where the photo-sensitive layer 30' includes four photo-sensitive units 31', the second metal electrode 20' includes four first hollow regions 21', and each first hollow region 21' includes fifteen first hollow structures 22' is used as an example for description. That is, the number of the first hollow structures 22' corresponding to each photo-sensitive unit 31' is consistent. In other embodiments, the number of the first hollow structures 22' corresponding to each photo-sensitive unit 31' may be inconsistent. In an embodiment, FIG. 31 is a top diagram of another phase shifter according to an embodiment of the present disclosure. As shown in FIG. 31, four photo-sensitive units 31' include a first photo-sensitive unit 311', a second photo-sensitive unit 312', a third photo-sensitive unit 313', and a fourth photo-sensitive unit 314'. The first photo-sensitive unit 311' overlaps five first hollow structures 22', the second photo-sensitive unit 312' overlaps nine first hollow structures 22', the third photo-sensitive unit 313' overlaps twelve first hollow structures 22', and the fourth photo-sensitive unit 314' overlaps fifteen first hollow structures 22'.

In an embodiment, with continued reference to FIGS. 29 and FIG. 30, the size of each first hollow structure 22' is greater than or equal to 2.5 μm and less than or equal to 25 μm.

In an embodiment, as shown in FIGS. 29 and 30, in the case where the shapes of the first hollow structures 22' include a circle, the diameter C1' of each first hollow structure 22' is, for example, greater than or equal to 2.5 μm and less than or equal to 25 μm. In the case where the shapes of the first hollow structures 22' include a square (not shown in the figure), the size of the side length of each first hollow structure 22' is greater than or equal to 2.5 μm and less than or equal to 25 μm. The size of each first hollow structure 22' is set to be greater than or equal to 2.5 μm and less than or equal to 25 μm. In this manner, the following cases can be avoided: the size of each first hollow structure 22' is too small so that the light emitted by the light source is unable to be irradiated to the photo-sensitive units 31'; the first hollow structures 22' are too large so that the electrical signals transmitted by the transmission electrodes 11' are leaked out through the first hollow structures 22'.

Figure 32:
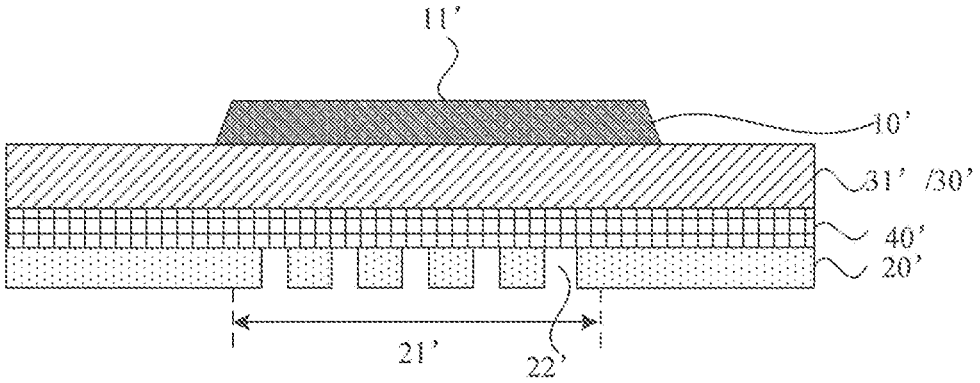
FIG. 32 is a structure diagram of part of film layers of a phase shifter according to an embodiment of the present disclosure.

In an embodiment, FIG. 32 is a structure diagram of part of film layers of a phase shifter according to an embodiment of the present disclosure. As shown in FIG. 32, in the case where each photo-sensitive unit 31' overlaps the first hollow structure 22', the phase shifter 200 provided in embodiments of the present disclosure further includes a light-transmissive conductive layer 40', and the light-transmissive conductive layer 40' is located between the photo-sensitive layer 30' and the second metal electrode 20'.

The light-transmissive conductive layer 40' may be, for example, a transparent conductive layer, that is, the light emitted by the light source may be irradiated to the photo-sensitive units 31' through the transparent conductive layer. In this case, the material of the transparent conductive layer may be, for example, indium tin oxide. The light-transmissive conductive layer 40' is not limited to a transparent conductive layer and may also be a conductive layer that only transmits light to which the photo-sensitive unit 31' is able to respond. The so-called light to which the photo-sensitive unit 31' is able to respond may be applied to following case: in the case where the light is irradiated to the photo-sensitive unit 31', the dielectric constant of the photo-sensitive unit 31' is changed. For example, the light to which the photo-sensitive unit 31' is able to respond is a blue light, and the light-transmissive conductive layer 40' may transmit the blue light.

In this embodiment, the light-transmissive conductive layer 40' is provided between the photo-sensitive layer 30' and the second metal electrode 20'. The light-transmissive conductive layer 40' is provided so that light may be irradiated to the photo-sensitive unit 31'. In this manner, the dielectric constant of the photo-sensitive unit 31' is changed, and the signals transmitted by the transmission electrodes 11' is prevented from leaking out through the first hollow structures 22'.

Based on the preceding solutions, the phase shifter provided in embodiments of the present disclosure further includes at least one layer of base substrate; the base substrate and the photo-sensitive unit are arranged in the same layer; and/or the base substrate and the photo-sensitive unit are arranged in different layers and overlap.

The material of the base substrate may be, for example, one of polyimide, glass, or liquid crystal polymer. It is to be understood that the material of the base substrate includes and is not limited to the preceding examples, and can make a selection according to the actual condition.

In this embodiment, other film layer structures in the phase shifter may be formed on the base substrate, and the phase shifter may be supported by, for example, the base substrate.

Figure 33:
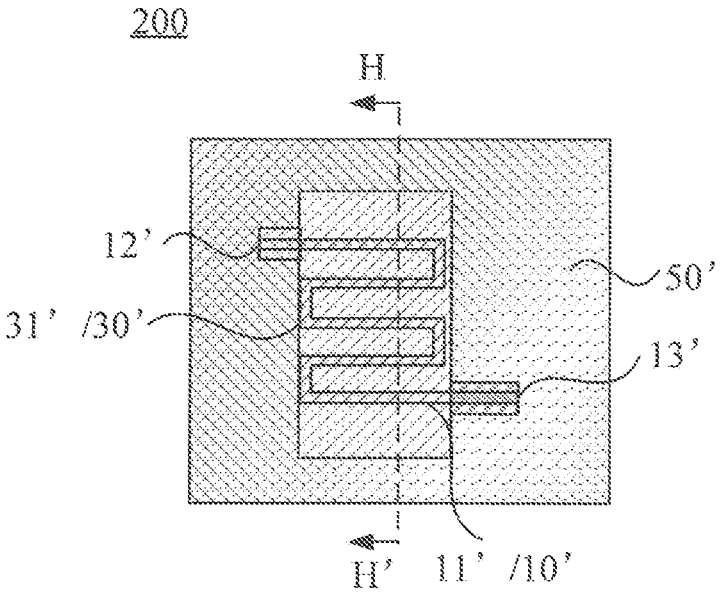
FIG. 33 is a top diagram of another phase shifter according to an embodiment of the present disclosure.
Figure 34:
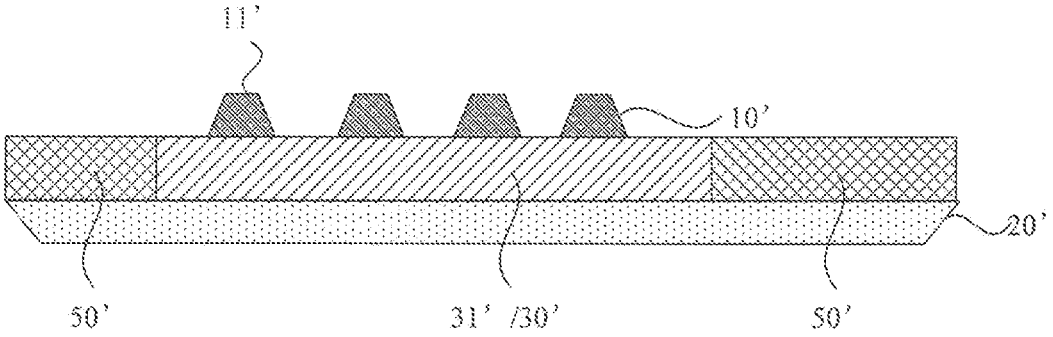
FIG. 34 is a structure diagram of FIG. 33 taken along an H-H' section.

In an embodiment, FIG. 33 is a top diagram of another phase shifter according to an embodiment of the present disclosure, and FIG. 34 is a structure diagram of FIG. 33 taken along an H-H' section. As shown in FIGS. 33 and 34, the phase shifter 200 provided in this embodiment includes one layer of base substrate 50', and the base substrate 50' and the photo-sensitive layer 31' are arranged in the same layer. In an embodiment, the preparation steps of the phase shifter 200 shown in FIG. 33 may be, for example, first, forming the second metal electrode 20' on one support layer (not shown in the figure); then disposing the base substrate 50' on one side of the second metal electrode 20' facing away from the support layer, where the base substrate 50' includes multiple groove structures, and all the multiple groove structures penetrate the base substrate 50'; then disposing the photo-sensitive unit 31' in each groove structure; then forming the first metal electrode 10' on one side of the base substrate 50' facing away from the second metal electrode 20'. If the phase shifter 200 includes the support layer, there is no need to peel off the support layer; if the phase shifter 200 does not need the support layer, the support layer may be peeled off after the first metal electrode 10' is formed as shown in FIGS. 33 and 34.

Figure 35:
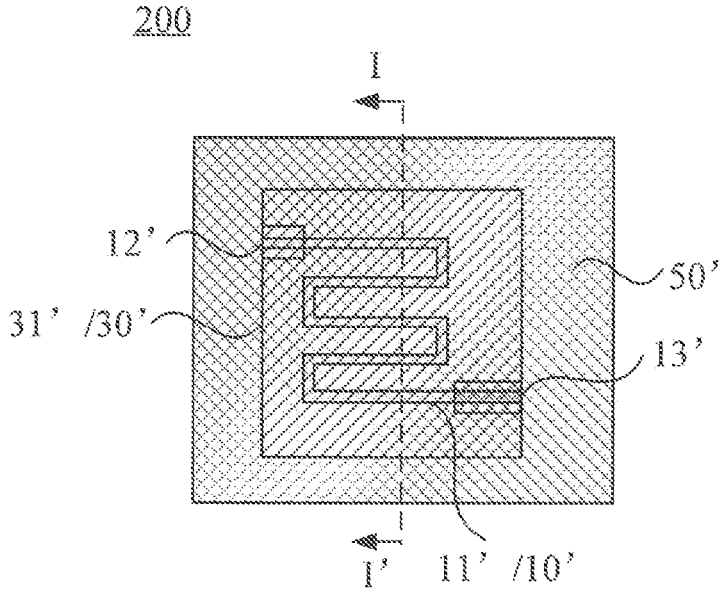
FIG. 35 is a top diagram of another phase shifter according to an embodiment of the present disclosure.
Figure 36:
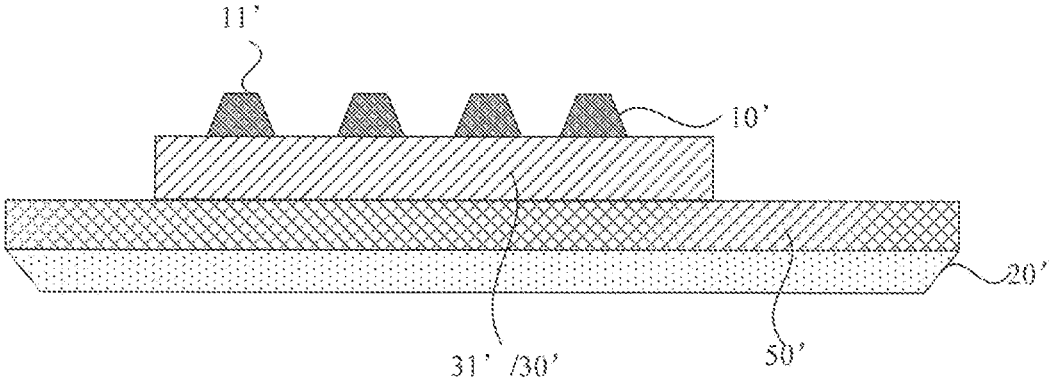
FIG. 36 is a structure diagram of FIG. 35 taken along an I-I' section.

In an embodiment, FIG. 35 is a top diagram of another phase shifter according to an embodiment of the present disclosure, and FIG. 36 is a structure diagram of FIG. 35 taken along an I-I' section. As shown in FIGS. 35 and 36, the phase shifter 200 provided in this embodiment includes one layer of base substrate 50', the base substrate 50' is located between the photo-sensitive layer 30' and the second metal electrode 20', and along the thickness direction of the photo-sensitive unit 31', the base substrate 50' overlaps the photo-sensitive unit 31'. It is to be noted that the base substrate 50' is a light-transmissive material and may be a light-transmissive organic substrate or a light-transmissive inorganic substrate. In one embodiment, the base substrate 50' may be a glass substrate, or a polyimide substrate, or a polymethyl methacrylate substrate, or a polystyrene substrate.

Figure 37:
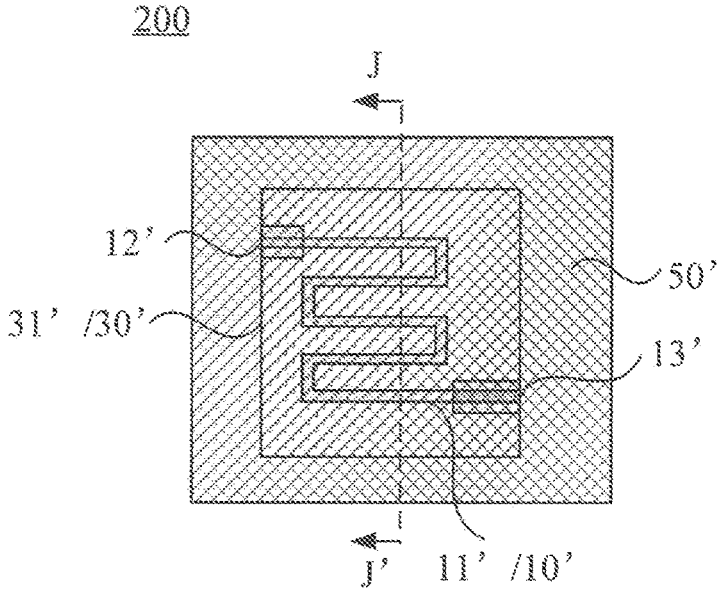
FIG. 37 is a top diagram of another phase shifter according to an embodiment of the present disclosure.
Figure 38:
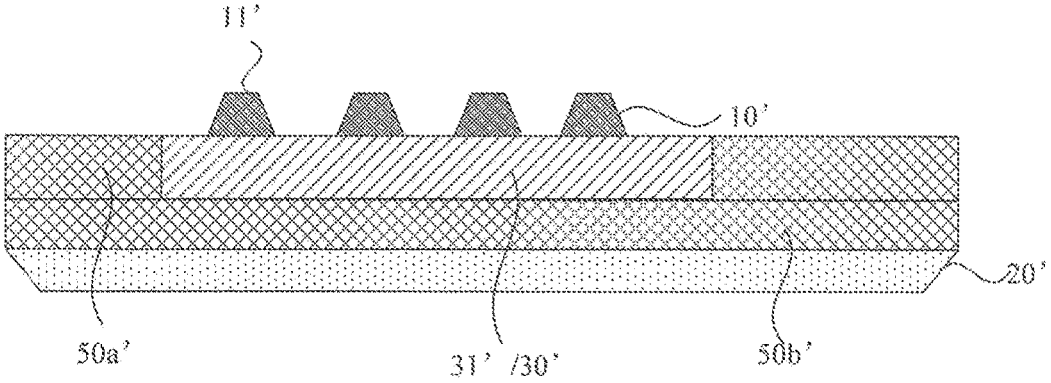
FIG. 38 is a structure diagram of FIG. 37 taken along a J-J' section.

In an embodiment, FIG. 37 is a top diagram of another phase shifter according to an embodiment of the present disclosure, and FIG. 38 is a structure diagram of FIG. 37 taken along a J-J' section. As shown in FIGS. 37 and 38, the phase shifter 200 provided in embodiments of the present disclosure further includes two layers of base substrates 50'; one base substrate **50*a*' and the photo-sensitive unit 31' are arranged in the same layer; the other base substrate 50*b*' and the photo-sensitive unit 31'** are arranged in different layers and overlap.

It is to be noted that in the case where the base substrates and the photo-sensitive unit are arranged in the same layer; or the base substrates and the photo-sensitive layer are arranged in different layers and overlap; or one of the base substrates and the photo-sensitive layer are arranged in the same layer; the other base substrate and the photo-sensitive layer are arranged in different layers and overlap, the preceding contents respectively show an example. However, in the case where the phase shifter further includes at least one layer of base substrate; the specific embodiments in which the base substrate and the photo-sensitive unit are arranged in the same layer; and/or the base substrate and the photo-sensitive unit are arranged in different layers and overlap further includes multiple types. Typical examples will be described below. The following content does not belong to the limitation to the present disclosure.

Figure 39:
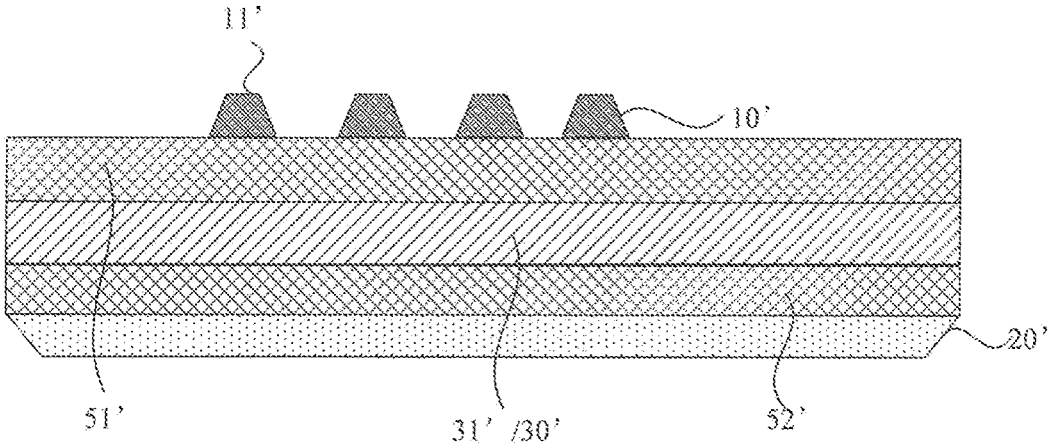
FIG. 39 is a structure diagram of part of film layers of another phase shifter according to an embodiment of the present disclosure.

In an embodiment, FIG. 39 is a structure diagram of part of film layers of another phase shifter according to an embodiment of the present disclosure. As shown in FIG. 39, at least one layer of base substrate 50' includes two layers of base substrates; the two layers of base substrates 50' include a first base substrate 51' and a second base substrate 52'; the first base substrate 51' and the photo-sensitive layer 30' are arranged in different layers and overlap, the second base substrate 52' and the photo-sensitive layer 30' are arranged in different layers and overlap, and the first base substrate 51' and the second base substrate 52' are respectively located on two sides of the photo-sensitive layer 30'. For example, the first base substrate 51' is located between the photo-sensitive layer 30' and the first metal electrode 10', and the second base substrate 52' is located between the photo-sensitive layer 30' and the second metal electrode 20'. The phase shifter 200 provided in this embodiment has a simple structure. In this manner, when the phase shifter 200 is prepared, the process steps can be simplified and the preparing efficiency of the phase shifter 200 can be improved.

Figure 40:
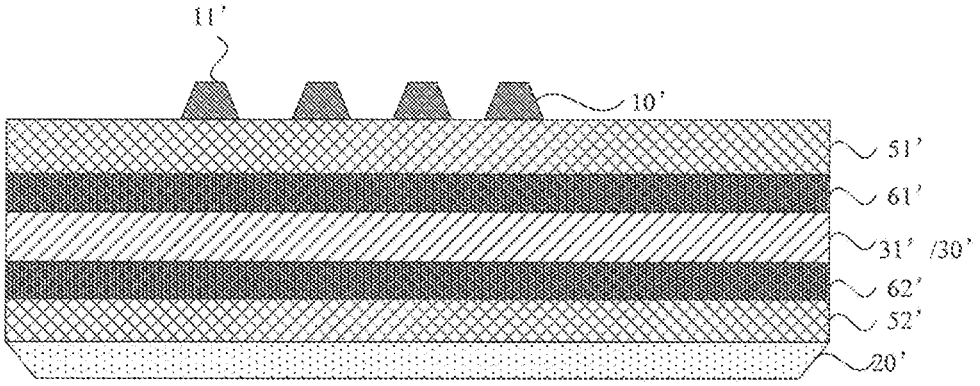
FIG. 40 is a structure diagram of part of film layers of another phase shifter according to an embodiment of the present disclosure.

In an embodiment, FIG. 40 is a structure diagram of part of film layers of another phase shifter according to an embodiment of the present disclosure. As shown in FIG. 40, at least one layer of base substrate 50' includes two layers of base substrates; the two layers of base substrates 50' include a first base substrate 51' and a second base substrate 52'; the first base substrate 51' and the photo-sensitive layer 30' are arranged in different layers and overlap, the second base substrate 52' and the photo-sensitive layer 30' are arranged in different layers and overlap, and the first base substrate 51' and the second base substrate 52' are respectively located on two sides of the photo-sensitive layer 30'; the phase shifter 200 further includes a first adhesive layer 61' and a second adhesive layer 62'; the first adhesive layer 61' is provided between the first base substrate 51' and the photo-sensitive layer 30'; the second adhesive layer 62' is provided between the second base substrate 52' and the photo-sensitive layer 30'.

The first adhesive layer 61' and the second adhesive layer 62' may include, for example, OC optical glue.

It is to be noted that, in this embodiment, the photo-sensitive layer 30' and the first base substrate 51', and the photo-sensitive layer 30' and the second base substrate 52' are fixed by bonding. In this case, the photo-sensitive layer 30' is a diaphragm structure. Therefore, the photo-sensitive layer 30' is directly bonded to the relatively smooth side of the first base substrate 51' and the relatively smooth side of the second base substrate 52' so that the flatness of the photo-sensitive layer 30' is improved, and thus the thickness of the photo-sensitive layer 30' at the corresponding position of each transmission electrode 11' is consistent.

In an embodiment, the preparation steps of the phase shifter shown in FIG. 40 may be, for example, first, forming the first metal electrode 10' on the first base substrate 51', and forming the second metal electrode 20' on the second base substrate 52'; then bonding the photo-sensitive layer 30' to one side of the second base substrate 52' facing away from the second metal electrode 20' through the second adhesive layer 62'; and then bonding the first base substrate 51' to one side of the photo-sensitive layer 30' facing away from the second adhesive layer 62' through the first adhesive layer 61'. The first metal electrode 10' on the first base substrate 51' is located on one side of the first adhesive layer 61' facing away from the photo-sensitive layer 30'.

It is to be understood that in the case where the phase shifter is the structure shown in FIG. 40, the preparation steps of the phase shifter include and are not limited to the preceding examples.

Figure 41:
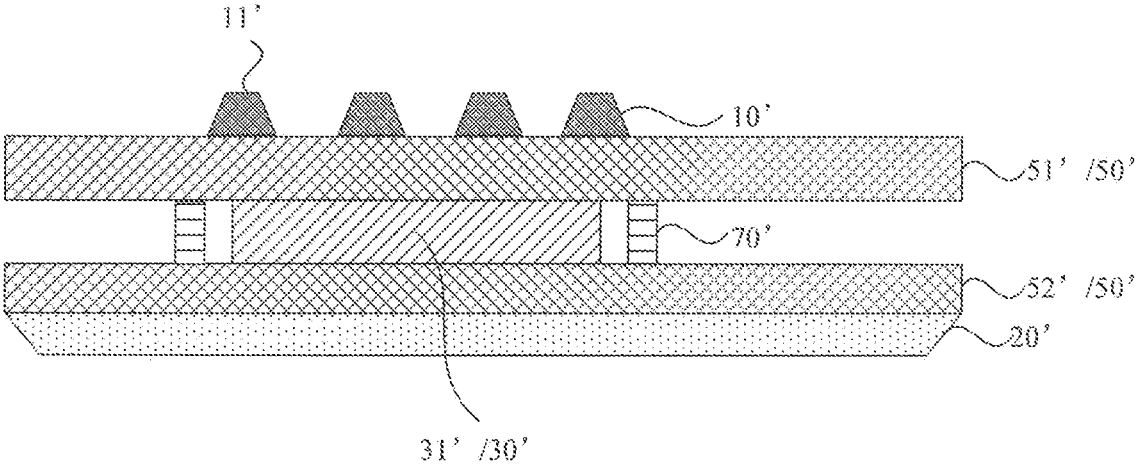
FIG. 41 is a structure diagram of part of film layers of another phase shifter according to an embodiment of the present disclosure.

In an embodiment, FIG. 41 is a structure diagram of part of film layers of another phase shifter according to an embodiment of the present disclosure. As shown in FIG. 41, at least one layer of base substrate 50' includes two layers of base substrates; the two layers of base substrates 50' include a first base substrate 51' and a second base substrate 52'; the first base substrate 51' and the photo-sensitive layer 30' are arranged in different layers and overlap, the second base substrate 52' and the photo-sensitive layer 30' are arranged in different layers and overlap, and the first base substrate 51' and the second base substrate 52' are respectively located on two sides of the photo-sensitive layer 30'; the phase shifter 200 further includes a frame sealing structure 70', and the frame sealing structure 70' is located between the first base substrate 51' and the second base substrate 52'; the first base substrate 51', the second base substrate 52', and the frame sealing structure 70' form an accommodation space, and the photo-sensitive unit 31' is provided in the accommodation space.

The frame sealing structure 70' may be, for example, frame sealing glue. The frame sealing glue is sticky, has strong plasticity under the normal condition, and has mechanical properties when cured through light or other manners. Therefore, the first base substrate 51' and the second base substrate 52' may be sealed by the frame sealing glue. In this manner, in the case where the photo-sensitive unit 31' is in a fluid state, the photo-sensitive unit 31' can be prevented from leaking.

In this embodiment, the accommodation space is formed by the first base substrate 51', the second base substrate 52', and the frame sealing structure 70', and the photo-sensitive unit 31' is disposed in the accommodation space. In this case, the photo-sensitive unit 31' may be in a fluid state or in a solid state. In this manner, the selection range of the material of the photo-sensitive unit 31' may be expanded, and the material of the photo-sensitive unit 31' may be selected more flexibly.

Figure 42:
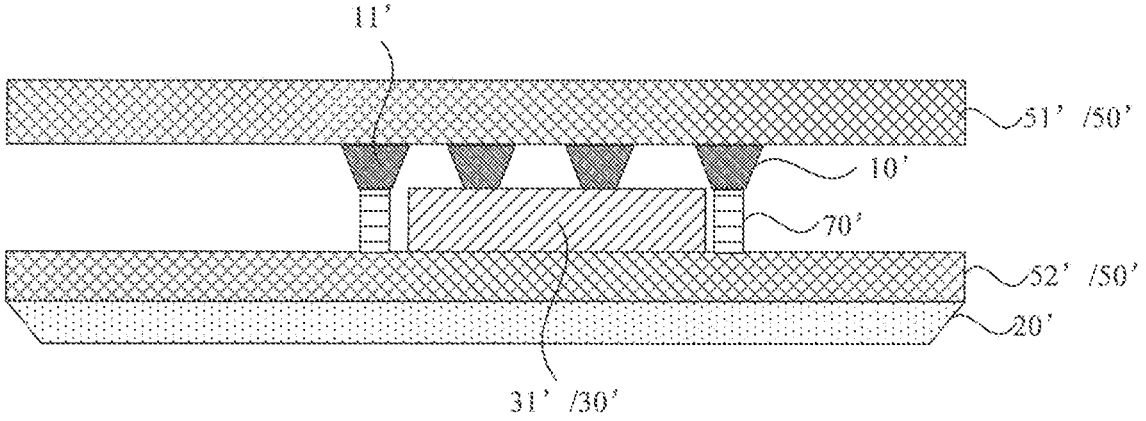
FIG. 42 is a structure diagram of part of film layers of another phase shifter according to an embodiment of the present disclosure.

In an embodiment, FIG. 42 is a structure diagram of part of film layers of another phase shifter according to an embodiment of the present disclosure. As shown in FIG. 42, unlike FIG. 41, in FIG. 42, the first base substrate 51' is located on one side of the first metal electrode 10' farther from the photo-sensitive layer 30'; the second base substrate 52' is located on one side of the second metal electrode 20' farther from the photo-sensitive layer 30'. In FIG. 41, the first base substrate 51' is located on one side of the first metal electrode 10' closer to the photo-sensitive layer 30'; the second base substrate 52' is located on one side of the second metal electrode 20' closer to the photo-sensitive layer 30'.

In an embodiment, the preparation steps of the phase shifter shown in FIGS. 41 and 42 may be, for example, forming the first metal electrode 10' on the first base substrate 51' and forming the second metal electrode 20' on the second base substrate 52'; bonding the first base substrate 51' on which the first metal electrode 10' is formed and the second base substrate 52' on which the second metal electrode 20' is formed in an aligned manner to form an accommodation space so that the frame sealing structure 70' and the photo-sensitive unit 31' are located between the first base substrate 51' and the second base substrate 52', and the frame sealing structure 70' is disposed around the photo-sensitive unit 31'.

In the embodiment of FIG. 42, the first metal electrode 10' is located on one side of the first base substrate 51' closer to the photo-sensitive unit 31' so that the loss of signal transmission can be further reduced; at the same time, the thickness of the first base substrate 51' does not need to be limited and the process requirements can be reduced.

Figure 43:
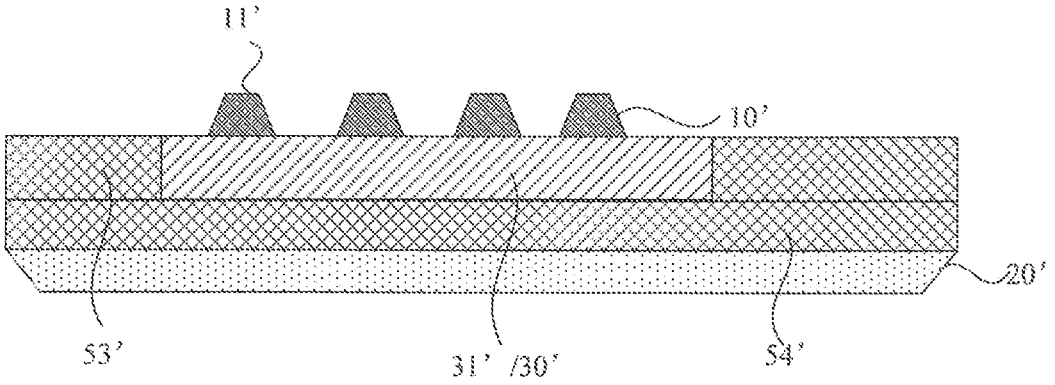
FIG. 43 is a structure diagram of part of film layers of another phase shifter according to an embodiment of the present disclosure.

In an embodiment, FIG. 43 is a structure diagram of part of film layers of another phase shifter according to an embodiment of the present disclosure. As shown in FIG. 43, at least one layer of base substrate 50' includes two layers of base substrates; the two layers of base substrates 50' include a third base substrate 53' and a fourth base substrate 54'; the third base substrate 53' and the photo-sensitive layer 30' are arranged in the same layer, and the fourth base substrate 54' is located on one side of the photo-sensitive layer 30'; the material of the third base substrate 53' includes polyimide, and the material of the fourth base substrate 54' includes glass or liquid crystal polymer.

In an embodiment, the preparation steps of the phase shifter shown in FIG. 43 may be, for example, providing one fourth base substrate 54', where the fourth base substrate 54' is a rigid substrate, the material of the fourth base substrate 54' may be, for example, glass or liquid crystal polymer, other film layers of the phase shifter are provided on the fourth base substrate 54', and the support layer does not need to be disposed individually; then coating polyimide on the fourth base substrate 54' by, for example, a coating process and performing curing to form the third base substrate 53'; then grooving the third base substrate 53' to form multiple groove structures, where for example, the multiple groove structures penetrate the third base substrate 53'; then disposing the photo-sensitive unit 31' in each groove structure; then forming the second metal electrode 20' on the fourth base substrate 54', and forming the first metal electrode 10' on the third base substrate 53'. Since the fourth base substrate 54' is a rigid substrate (glass or liquid crystal polymer) and the material of the third base substrate 53' is polyimide, the polyimide may be directly coated on the fourth base substrate 54' by a coating process. In this case, a glue layer does not need to be disposed between the third base substrate 53' and the fourth base substrate 54' so that which the process steps can be simplified and the manufacturing cost of the phase shifter can be reduced.

Figure 44:
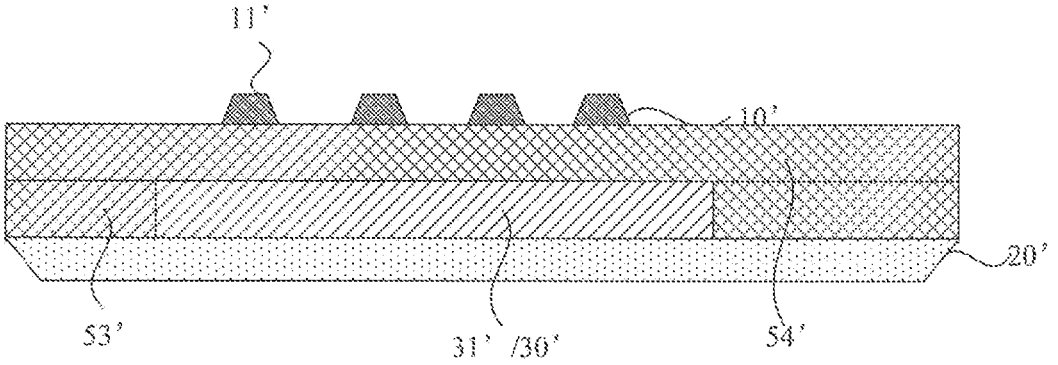
FIG. 44 is a structure diagram of part of film layers of another phase shifter according to an embodiment of the present disclosure.

It is to be noted that, in FIG. 43, the case where the fourth base substrate 54' is located on one side of the photo-sensitive layer 30' facing away from the first metal electrode 10' is used as an example. In other embodiments, the fourth base substrate 54' may also be located on one side of the photo-sensitive layer 30' closer to the first metal electrode 10'. For example, referring to FIG. 44, in this case, a glue layer does not need to be disposed between the third base substrate 53' and the fourth base substrate 54'.

In the preceding embodiments, in the case where the base substrate 50' and the photo-sensitive unit 31' are arranged in different layers and overlap, the base substrate 50' includes a light-transmissive base substrate. The advantage of this arrangement is that the light emitted by the light source may be irradiated to the photo-sensitive unit 31' through the light-transmissive base substrate 50'; at the same time, the phase shifter may be supported.

Figure 45:
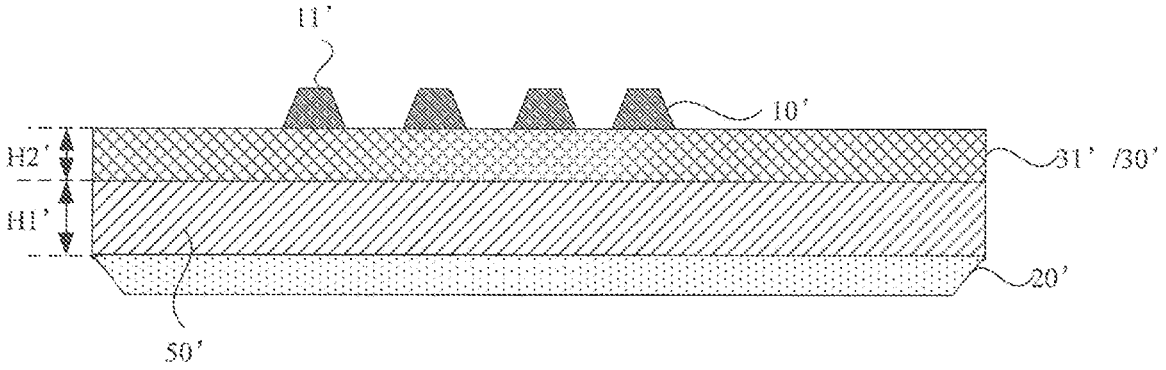
FIG. 45 is a structure diagram of part of film layers of another phase shifter according to an embodiment of the present disclosure.

In the preceding embodiments, FIG. 45 is a structure diagram of part of film layers of another phase shifter according to an embodiment of the present disclosure. Referring to FIG. 45, sin the case where the base substrate 50' and the photo-sensitive unit 31' are arranged in different layers and overlap, the thickness H1' of the photo-sensitive unit 31' is greater than the thickness H2' of the base substrate 50'. In this manner, the influence of the photo-sensitive unit 31' on the electrical signals is increased.

It is to be noted that in FIG. 45, only the case where the phase shifter includes one layer of base substrate 50', and the base substrate 50' is located between the photo-sensitive layer 30' and the first metal electrode 10' is used as an example for description, which does not constitute a limitation to the present application. As long as the phase shifter includes the base substrate 50', and the base substrate 50' and the photo-sensitive unit 31' are arranged in different layers and overlap, the preceding thickness relationship may be satisfied.

Embodiments of the present disclosure further provide a communication device. The communication device includes a light source and the antenna of any one of the above; or the communication device includes a light source and the phase shifter of any one of the above; where the light source is configured to emit light that is irradiated to the photo-sensitive layer so that the dielectric constant of the photo-sensitive layer is changed. The communication device may be placed inside the car so that the car is able to receive the signals.

Figure 46:
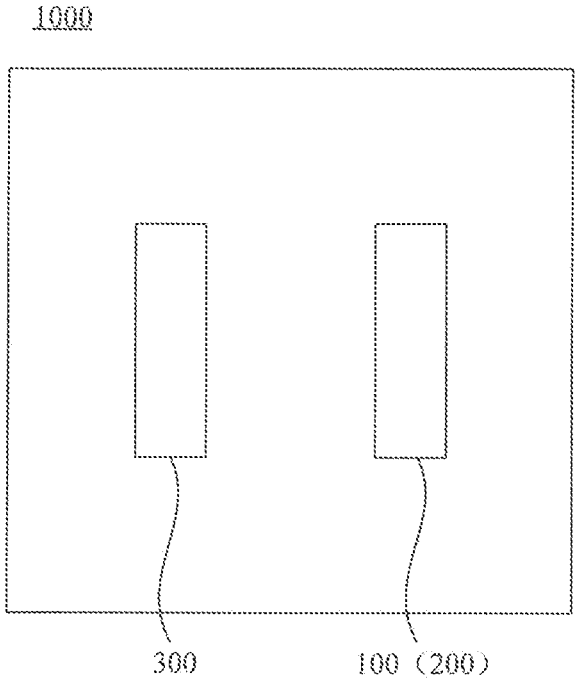
FIG. 46 is a structure diagram of a communication device according to an embodiment of the present disclosure.

In an embodiment, FIG. 46 is a structure diagram of a communication device according to an embodiment of the present disclosure. The communication device 1000 includes a light source 300 and an antenna 100; or the communication device includes a light source 300 and a phase shifter 200. The light source 300 may be independent of the antenna 100/phase shifter 200, or may be combined with the antenna 100/phase shifter 200. The specific arrangement of the light source 300 is not limited in embodiments of the present application as long as the light emitted by the light source may be irradiated to the photo-sensitive unit at the corresponding position of the transmission electrode.

What is claimed is:

1. An antenna comprising:

a first metal electrode, a second metal electrode, and a photo-sensitive layer, wherein the first metal electrode and the second metal electrode are respectively located on two opposite sides of the photo-sensitive layer;

the first metal electrode comprises a plurality of transmission electrodes; the plurality of transmission electrodes are configured to transmit electrical signals; and the photo-sensitive layer comprises at least one photo-sensitive unit and the at least one photo-sensitive unit overlaps the plurality of transmission electrodes, wherein when the photo-sensitive layer comprises one photo-sensitive unit, the one photo-sensitive unit is a full layer structure, when the photo-sensitive layer comprises a plurality of photo-sensitive units, the plurality of photo-sensitive units are in a same layer and each photo-sensitive unit corresponds to and overlaps a respective one of the multiple transmission electrodes, and wherein a dielectric constant of the photo-sensitive layer is changed according to light irradiated to the photo-sensitive layer.

2. The antenna of claim 1, wherein a frequency of each electrical signal of the electrical signals is greater than or equal to 1 GHz.

3. The antenna of claim 1, wherein the second metal electrode is provided with a fixed potential.

4. The antenna of claim 1, wherein a shape of each transmission electrode of the plurality of transmission electrodes comprises a linear shape;

the linear shape comprises a plurality of segments connected to each other, and extension directions of at least two segments of the plurality of segments intersect.

5. The antenna of claim 4, wherein a line width of each transmission electrode is W, wherein 10 μm≤W≤500 μm.

6. The antenna of claim 1, wherein the photo-sensitive layer comprises:

a plurality of photo-sensitive units; and the second metal electrode comprises a plurality of first hollow regions, and each first hollow area of the plurality of first hollow areas comprises at least one first hollow structure;

each photo-sensitive unit of the plurality of photo-sensitive units overlaps the at least one first hollow structure.

7. The antenna of claim 6 further comprising a light-transmissive conductive layer, wherein the light-transmissive conductive layer is located between the photo-sensitive layer and the second metal electrode.

8. The antenna of claim 6, wherein a size of each first hollow structure of the at least one first hollow structure is greater than or equal to 2.5 μm and less than or equal to 25 μm.

9. The antenna of claim 1 further comprising at least one layer of base substrate, wherein a base substrate and the at least one photo-sensitive unit are arranged in at least one of:

the base substrate and the at least one photo-sensitive unit are arranged in a same layer; or the base substrate and the at least one photo-sensitive unit are arranged in different layers and overlap.

10. The antenna of claim 9, wherein the at least one layer of base substrate comprises two layers of base substrates;

the two layers of base substrates comprise a first base substrate and a second base substrate; and the first base substrate and the photo-sensitive layer are arranged in different layers and overlap, the second base substrate and the photo-sensitive layer are arranged in different layers and overlap, and the first base substrate and the second base substrate are respectively located on either sides of the photo-sensitive layer.

11. The antenna of claim 10 further comprising a first adhesive layer and a second adhesive layer, wherein the first adhesive layer is provided between the first base substrate and the photo-sensitive layer; and the second adhesive layer is provided between the second base substrate and the photo-sensitive layer.

12. The antenna of claim 10 further comprising:

a frame sealing structure, wherein the frame sealing structure is located between the first base substrate and the second base substrate; and the first base substrate, the second base substrate, and the frame sealing structure form an accommodation space, and the at least one photo-sensitive unit is provided in the accommodation space.

13. The antenna of claim 9, wherein the base substrate and the at least one photo-sensitive unit are arranged in different layers and overlap;

the base substrate is located on one side of the second metal electrode facing away from the first metal electrode;

the second metal electrode comprises a plurality of second hollow structures, and a vertical projection of each second hollow structure of the plurality of second hollow structures on a plane where the base substrate is located is within a vertical projection of the plurality of transmission electrodes on the plane where the base substrate is located;

the antenna further comprises a third metal electrode, wherein the third metal electrode is located on one side of the base substrate facing away from the second metal electrode; the third metal electrode comprises a plurality of radiators; and the vertical projection of the each second hollow structure on the plane where the base substrate is located is within a vertical projection of the plurality of radiators on the plane where the base substrate is located.

14. The antenna of claim 9, wherein the base substrate and the at least one photo-sensitive unit are arranged in a same layer;

the first metal electrode further comprises a plurality of radiators; and a vertical projection of the plurality of radiators on a plane where the base substrate is located is within the base substrate.

15. The antenna of claim 1 further comprising a feed network, wherein the feed network and the plurality of transmission electrodes are arranged in a same layer, and the feed network is electrically connected to the plurality of transmission electrodes.

16. The antenna of claim 15, wherein the first metal electrode further comprises:

a plurality of radiators; and the plurality of radiators, the plurality of transmission electrodes, and the feed network are arranged in a same layer, and the plurality of transmission electrodes are electrically connected to the plurality of radiators.

17. The antenna of claim 1, wherein the material of the at least one photo-sensitive unit comprises azo dye or azo polymer.

18. The antenna of claim 1, wherein a thickness of the photo-sensitive layer is H, wherein 10 μm≤H≤1000 μm.

19. A communication device comprising:

a light source and the antenna of claim 1, wherein the light source is configured to emit light that is irradiated to the photo-sensitive layer so that a dielectric constant of the photo-sensitive layer is changed.

* * * * *